US005178992A

United States Patent [19]

Yoshida et al.

[11] Patent Number: 5,178,992

[45] Date of Patent: Jan. 12, 1993

[54] METHOD FOR PROCESSING SILVER HALIDE COLOR PHOTOGRAPHIC MATERIAL

[75] Inventors: Kazuaki Yoshida; Hiroshi Fujimoto, both of Minami-ashigara, Japan

[73] Assignee: Fuji Photo Film Co., Ltd., Kanagawa, Japan

[21] Appl. No.: 574,402

[22] Filed: Aug. 29, 1990

[30] Foreign Application Priority Data

Sep. 1, 1989 [JP] Japan ..... 1-227223

[51] Int. Cl.[5] ..... G03C 7/32; G03C 1/79

[52] U.S. Cl. ..... 430/372; 430/380; 430/490; 430/536; 430/538; 430/551

[58] Field of Search ..... 430/380, 372, 538, 551, 430/490, 536

[56] References Cited

U.S. PATENT DOCUMENTS

| | | | |
|---|---|---|---|
| 3,411,908 | 11/1968 | Crawford et al. . | |
| 4,508,751 | 4/1985 | Tamagawa et al. | 430/538 |
| 4,517,285 | 5/1985 | Woodward et al. | 430/538 |
| 4,675,245 | 6/1987 | von Meer | 430/328 |
| 4,798,783 | 1/1989 | Ishikawa et al. | 430/372 |
| 4,801,516 | 1/1989 | Ishikawa et al. | 430/380 |
| 4,853,318 | 8/1989 | Fujita et al. | 430/380 |
| 4,876,174 | 10/1989 | Ishikawa et al. | 430/380 |
| 5,057,405 | 10/1991 | Shiba et al. | 430/538 |
| 5,075,202 | 12/1991 | Koboshi et al. | 430/372 |

FOREIGN PATENT DOCUMENTS

| | | | |
|---|---|---|---|
| 63-014147 | 1/1988 | Japan | 430/380 |
| 63-237057 | 10/1988 | Japan | 430/536 |
| 1-189651 | 7/1989 | Japan | 430/538 |

OTHER PUBLICATIONS

Abstract Bulletin of the Institute of Paper Chemistry, vol. 52, No. 8, Feb. 1982, Appleton, U.S., p. 984, Abstract No. 9291 & JP-56109343 (Mitsubishi Paper Mfg. Co., Ltd.).

Research Disclosure, vol. 176, Dec. 1978, Havant GB, pp. 22-31; Eastman Kodak Co.: "Photographic Silver Halide Emulsions, Preparations, Addenda, Processing and Systems".

Patent Abstracts of Japan, vol. 9, No. 44, (P-337) (1767) Feb. 23, 1985, & JP-A-59 182441 (Mitsubishi Seishi KK) Oct. 17, 1984.

*Primary Examiner*—Marion E. McCamish
*Assistant Examiner*—Janis L. Dote
*Attorney, Agent, or Firm*—Sughrue, Mion, Zinn, Macpeak & Seas

[57] ABSTRACT

There is disclosed a method for processing a silver halide color photographic material paper base of which contains at least one of specified sizing agents with a color developer containing a hydroxylamine compound. According to the disclosure edge stain due to penetration of the color developer into the paper base is prevented.

16 Claims, No Drawings

METHOD FOR PROCESSING SILVER HALIDE COLOR PHOTOGRAPHIC MATERIAL

FIELD OF THE INVENTION

The present invention relates to a method for development processing silver halide color photographic materials, and more particularly to a method for development processing wherein edge stain due to penetration of the development processing solution from the cut end of the base is prevented.

BACKGROUND OF THE INVENTION

Although conventionally, as a reflection base for photography, so-called baryta paper, made of paper whose one surface is coated with a baryta layer composed mainly of barium sulfate, is used, recently use has been made of a waterproof base obtained by both-side coating of base paper with a resin, so that development processing may be simplified and may be made rapid. However, even if such a waterproof base is used, penetration of developing solutions from the cut end of the base cannot be prevented. The developing solution penetration from the cut surfaces of the ends cannot be eliminated by a short-period treatment, and the penetrated part turns brown due to heat or with time, which becomes stain at the edge sections of the photograph, thereby spoiling considerably the photographic value. To prevent such edge stain, a technique wherein base paper layers are made highly sized is attempted.

For example, aliphatic acid soap-type sizing agents, as shown in JP-B ("JP-B" means examined Japanese patent publication) No. 26961/1972, and alkylketene dimers, as shown in JP-A ("JP-A" means unexamined published Japanese patent application) No. 132822/1986, are used as sizing agents for photographic base paper, but they have their respective disadvantages and are not satisfactory. That is, aliphatic acid soap-type sizing agents have such defects as that the sizing effect is low against the alkalis in developing solutions, the strength of the paper decreases greatly as the added amount of the sizing agent is increased, and the stiffness of the paper lowers. On the other hand, in the case of alkylketene dimers, although the sizing property against water is good, they have such defects as that the sized properties against alkaline water and water containing organic solvents, such as alcohols, are poor, and known polyamide-polyamine-epichlorohydrin resin as a fixing agent is required to be used in a relatively large amount. Thus, neither sizing agent is satisfactory enough to be used for photographic base paper.

That is, it is strongly desired to develop such a technique that edge stain is prevented by using smaller amount of sizing agent, in view of paper strength and stiffness, in combination with a smaller amount of polyamide-polyamine-epichlorohydrin resin.

In recent years, in the photographic processing of color photographic materials, along with the shortening of the delivery period of the finished product and the lightening of the laboratory work, desirably the processing time is shortened and the replenishing amount of the processing solution and the amount of waste liquor are reduced. These are already effected practically in mini-laboratories and is spreading into the market. Along with the rapid processing, processing conditions, for example, the increase of the processing solution temperature, the shortening of the washing out period, the deterioration (coloring and tar-forming for the developing solution) of the processing solution owing to the reduction of the replenishing amount, and the increase of the accumulated concentration of materials dissolved out from the photographic material are becoming severe, and it is earnestly desired to find a solution to the above edge stain problem.

BRIEF SUMMARY OF THE INVENTION

Therefore, the object of the present invention is to provide a method for development processing wherein penetration of a developing solution into the end sections of a photographic base prepared by both-side coating of a base paper with a resin is prevented, thereby remarkably suppressing edge stain.

Other and further objects, features and advantages of the invention will appear more evident from the following description.

DETAILED DESCRIPTION OF THE INVENTION

The object of the present invention has been attained by providing a method for processing a silver halide color photographic material having photosensitive silver halide emulsion layers on a paper base whose both sides are coated with a polyolefin with a color developer containing at least one aromatic primary amine color-developing agent, characterized in that said paper base contains at least one compound selected from the group consisting of epoxidized higher aliphatic acid amides, alkylketene dimers, higher aliphatic acid salts, and alkenyl succinic anhydrides, and said color developer contains a compound represented by the following formula (I) or its salt:

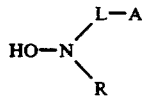

Formula (I)

wherein L represents an alkylene group which may be substituted, A represents a carboxyl group, a sulfo group, a phosphono group, a phosphinic acid residue, a hydroxyl group, an amino group which may be substituted by an alkyl group, an ammonio group which may be substituted by an alkyl group, a carbamoyl group which may be substituted by an alkyl group, a sulfamoyl group which may be substituted by an alkyl group, an alkylsulfonyl group which may be substituted, and R represents a hydrogen atom or an alkyl group which may be substituted. In this specification and claims, the alkyl group represented by L in formula (I) includes a substituted alkyl group, the amino group, ammonio group, carbamoyl group, and sulfamoyl group represented by A in formula (I) each include ones substituted by an alkyl group; the alkylsulfonyl group represented by A in formula (I) includes substituted alkylsulfonyl group, and the alkyl group represented by R in formula (I) includes substituted alkyl group.

Now formula (I) will be described in more detail.

In formula (I), L represents a straight-chain or branched-chain alkylene group which may be substituted having 1 to 10, preferably 1 to 5, carbon atoms. As specific preferable examples, methylene, ethylene, trimethylene, and propylene can be mentioned. The substituent includes a carboxyl group, a sulfo group, a phosphono group, a phosphinic acid residue, a hydroxyl group, and an ammonio group which may be substituted by an alkyl group (the substituent alkyl preferably having 1 to 5 carbon atoms), and as preferable examples, a carboxyl group, a sulfo group, a phosphono group, and a hydroxyl group can be mentioned. A represents a carboxyl group, a sulfo group, a phosphono group, a phosphinic acid residue, a hydroxyl group, an amino group which may be substituted by an alkyl group (the substituent alkyl preferably having 1 to 5 carbon atoms), an ammonio group which may be substituted by an alkyl group (the substituent alkyl preferably having 1 to 5 carbon atoms), a carbamoyl group which may be substituted by an alkyl group (the substituent alkyl preferably having 1 to 5 carbon atoms), a sulfamoyl group which may be substituted by an alkyl group (the substituent alkyl preferably having 1 to 5 carbon atoms), or an alkylsulfonyl group which may be substituted, and preferable examples are a carboxyl group, a sulfo group, a hydroxyl group, a phosphono group, and a carbamoyl group which may be substituted by an alkyl group. Preferable examples of -L-A include a carboxymethyl group, a carboxyethyl group, a carboxypropyl group, a sulfoethyl group, a sulfopropyl group, a sulfobutyl group, a phosphonomethyl group,.a phosphonoethyl group, and a hydroxyethyl group, and as particularly preferable examples a carboxymethyl group, a carboxyethyl group, a sulfoethyl group, a sulfopropyl group, a phosphonomethyl group, and a phosphonoethyl group can be mentioned. R represents a hydrogen atom or a straight-chain or branched-chain alkyl group which may be substituted having 1 to 10, preferably 1 to 5, carbon atoms. The substituent includes a carboxyl group, a sulfo group, a phosphono group, a phosphinic acid residue, a hydroxyl group, an amino group which may be substituted by an alkyl group, an ammonio group which may be substituted by an alkyl group, a carbamoyl group which may be substituted by an alkyl group, a sulfamoyl group which may be substituted by an alkyl group, an alkylsulfonyl group which may be substituted, an acylamino group, an alkylsulfonylamino group, an arylsulfonylamino group, an alkoxycarbonyl group, an amino group which may be substituted by an alkyl group, an arylsulfonyl group, a nitro group, a cyano group, or a halogen group. Two or more substituents may be present.

As preferable examples of R, a hydrogen atom, a methyl group, an ethyl group, a propyl group, a carboxymethyl group, a carboxyethyl group, a carboxypropyl group, a sulfoethyl group, a sulfopropyl group, a sulfobutyl group, a phosphonomethyl group,.a phosphonoethyl group, and a hydroxyethyl group can be mentioned, and as particularly preferable examples, a hydrogen atom, a carboxymethyl group, a carboxyethyl group, a sulfoethyl group, a sulfopropyl group, a phosphonomethyl group, and a phosphonoethyl group can be mentioned. L and R may bond together to form a ring.

When A or R has a dissociative proton, A or R can be used as an alkali metal salt, such as sodium or potassium salt.

The above-mentioned sizing agents have a deffect that they are not effective enough to prevent edge stain completely. Further, they have a deffect that the paper strength is lowered accompanied with the increase of added amount of them.

The inventors have studied in various way to prevent the above edge stain and have found that edge stain is prevented remarkably by the combination use of at least one of sizing agents of epoxidized higher aliphatic acid amides, alkylketene dimers, high aliphatic acids and alkenyl succinic anhydrides in the base paper with the compound represented by formula (I) in the color developer.

In view of the fact that the compound represented by formula (I), which is known as a preservative for developer, has almost no effect on sizing of paper, it is unexpected that its combination use with the above sizing agents shows a specific sizing effect.

It is hitherto known that when an alkylketene dimer is used as a sizing agent, the sizing effect is low for alcohols, such as benzyl alcohol, present in the developer. The fact that the compound represented by formula (I) increases the sizing effect has been discovered in the present invention for the first time.

Because the compound represented by formula (I) has almost no effect on sizing of paper, it is assumed that the sizing effect due to the combination use comes from the increasing sizing effect of a certain amine compound represented by formula (I). But the details are not yet clear and will be revealed by a future research.

Further, by the combination use of the compound represented by formula (I) with the above sizing agent the amount of sizing agent to be added can be reduced and the deffect of lowering of paper strength due to the increasing of addition of sizing agent can be improved.

The processing solution used in the present invention will now be described in detail.

Specific examples of the compound represented by formula (I) in the present invention are listed below, but they do not restrict the present invention.

The amount of the below-mentioned compounds to be added to the color developer is 0.005 to 0.5 mol/l, and preferably 0.03 to 0.1 mol/l.

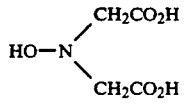
(I-1)

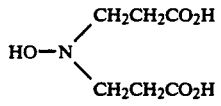
(I-2)

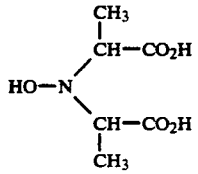
(I-3)

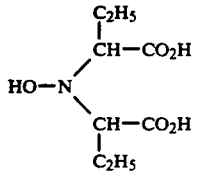
(I-4)

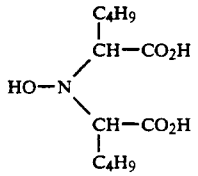
(I-5)

-continued
(I-6)
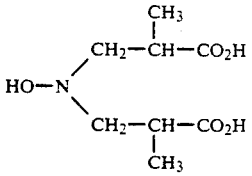
(I-7)
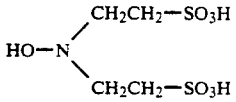
(I-8)
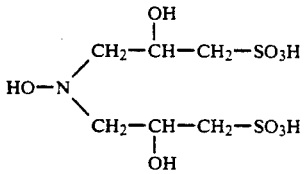
(I-9)
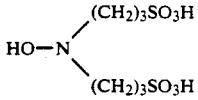
(I-10)
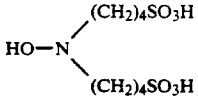
(I-11)
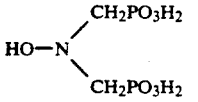
(I-12)
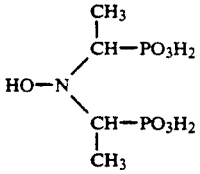
(I-13)
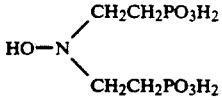
(I-14)
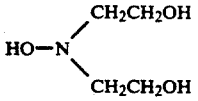
(I-15)
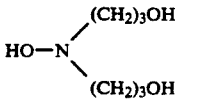
(I-16)
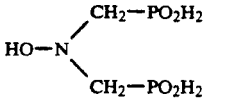
(I-17)
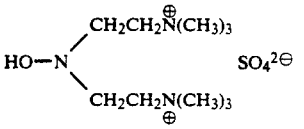
-continued
(I-18)
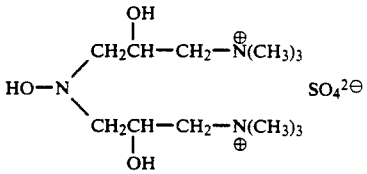
(I-19) $HO-NH-CH_2CO_2H$
(I-20) $HO-NH-CH_2CH_2CO_2H$
(I-21) $HO-NH-CH(CH_3)-CO_2H$
(I-22) $HO-NH-CH(C_2H_5)-CO_2H$
(I-23) $HO-NH-CH(C_4H_9)-CO_2H$
(I-24) $HO-NH-CH(CH_3)-CH_2-CO_2H$
(I-25) $HO-NH-CH_2-CH(CH_3)-CO_2H$
(I-26) $HO-NH-CH_2CH_2SO_3H$
(I-27) $HO-NH-CH_2CH(OH)CH_2SO_3H$
(I-28) $HO-NH-(CH_2)_3SO_3H$
(I-29) $HO-NH-(CH_2)_4SO_3H$
(I-30) $HO-NH-CH_2PO_3H_2$
(I-31) $HO-NH-CH(CH_3)-PO_3H_2$
(I-32) $HO-NH-CH_2CH_2PO_3H_2$
(I-33) $HO-NH-CH_2CH_2OH$
(I-34) $HO-NH-(CH_2)_3OH$
(I-35) $HO-NH-CH_2-PO_2H_2$
(I-36)
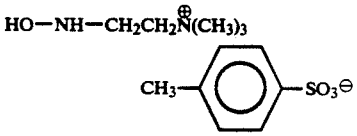
(I-37)
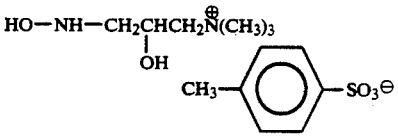
(I-38)
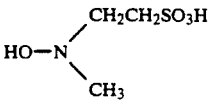

-continued (I-39)

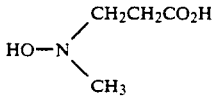

(I-40)

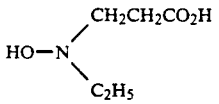

(I-41)

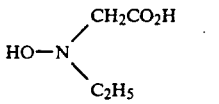

(I-42)

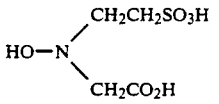

(I-43)

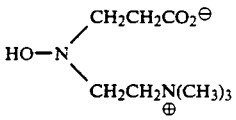

(I-44)

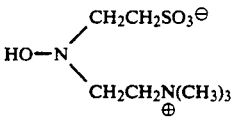

(I-45)

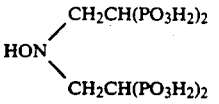

(I-46)

$HONHCH_2CH(PO_3H_2)_2$ (I-47)

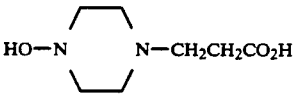

(I-48)

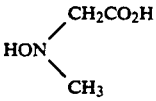

(I-49)

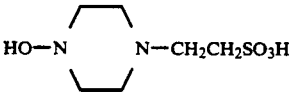

(I-50)

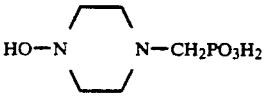

(I-51)

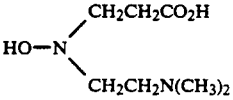

(I-52)

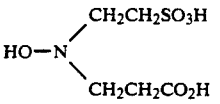

-continued (I-53)

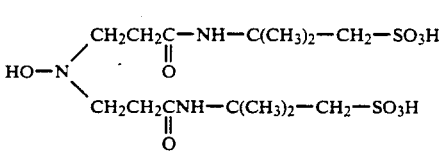

(I-54)

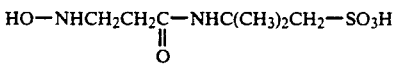

(I-55)

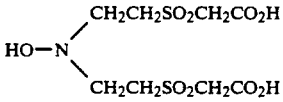

Of the above exemplified compounds, I-1, I-2, I-3, I-7, I-8, I-11, I-12, I-14, I-19, I-22, I-23, I-26, I-27, I-30, I-31, I-40, I-43, I-44, I-52, and I-53 are more preferable in view of prevention of edge stain and the preservation of developing agent.

Among them, I-2, and I-7, are particularly preferable in view of prevention of edge stain.

The compound represented by formula (I) can be synthesized by subjecting a commercially available hydroxylamine to an alkylation reaction (utilizing a nucleophilic substitution reaction, an addition reaction, and a Mannich reaction). Although the compounds represented by formula (I) can be synthesized in accordance with the synthesis method disclosed, for example, in West German Patent Publication No. 1159634 or *Inorganica Chimica Acta*, 93, (1984) 101-108, specific synthesis methods for them are described below.

SYNTHESIS EXAMPLES

Synthesis of Exemplified Compound (7)

11.5 g of sodium hydroxide and 96 g of sodium chloroethanesulfonate were added to 200 ml of an aqueous solution containing 20 g of hydroxylamine hydrochloride, and 40 ml of an aqueous solution containing 23 g of sodium hydroxide was added thereto gradually over 1 hour with the temperature being kept at 60° C. Further, while keeping the temperature at 60° C. for 3 hours, the reaction liquid was condensed under reduced pressure, then 200 ml of concentrated hydrochloric acid was added, and the mixture was heated to 50° C. The insolubles were filtered off, and 500 ml of methanol was added to the filtrate to obtain crystals of the monosodium salt of the desired product (Exemplified Compound (7)) in an amount of 41 g (yield: 53%).

Synthesis of Exemplified Compound (11)

32.6 g of formalin was added to a hydrochloric acid solution containing 7.2 g of hydroxylamine hydrochloride and 18.0 g of phosphorous acid, and the mixture was heated under reflux for 2 hours. The resulting crystals were recrystallized using water and methanol, to obtain 9.2 g of Exemplified Compound (11) (yield: 42%).

The color developer used in the present invention contains an aromatic primary amine color-developing agent. As the color-developing agent conventional ones can be used. Preferred examples of aromatic primary amine color-developing agents are p-phenylenediamine derivatives. Representative examples are given below, but they are not meant to limit the present invention:

D-1: N,N-diethyl-p-phenylenediamine

D-2: 2-amino-5-diethylaminotoluene
D-3: 2-amino-5-(N-ethyl-N-laurylamino)toluene
D-4: 4-[N-ethyl-N-(β-hydroxyethyl)amino]aniline
D-5: 2-methyl-4-[N-ethyl-N-(β-hydroxyethyl-)amino]aniline
D-6: 4-amino-3-methyl-N-ethyl-N-[β-(methanesulfonamido)ethyl]-aniline
D-7: N-(2-amino-5-diethylaminophenylethyl)methanesulfonamide
D-8: N,N-dimethyl-p-phenylenediamine
D-9: 4-amino-3-methyl-N-ethyl-N-methoxyethylaniline
D-10: 4-amino-3-methyl-N-ethyl-N-β-ethoxyethylaniline
D-11: 4-amino-3-methyl-N-ethyl-N-β-butoxyethylaniline Of the above-mentioned p-phenylenediamine derivatives, 4-amino-3-methyl-N-ethyl-N-[β-(methanesulfonamido)ethyl]-aniline (exemplified compound D-6) and 2-methyl-4-[N-ethyl-N-(β-hydroxyethyl)amino]-aniline (exemplified compound D-5) are particularly preferable.

These p-phenylenediamine derivatives may be in the form of salts such as sulfates, hydrochloride, sulfites, and p-toluenesulfonates. The amount of aromatic primary amine developing agent to be used is preferably about 0.1 g to about 20 g, more preferably about 0.5 g to about 15 g, per liter of developer.

In the present invention, a compound represented by formula (A) shown below is preferably used in view of improvement of preservativity of developer (prevention of deteriorations of developing agent and compound represented by formula (I) and prevention of tar. Further, compound (A-3) is preferably used in view of prevention of above-described edge stain.

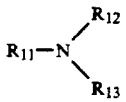
Formula (A)

wherein $R_{11}$ represents a hydroxyalkyl group having 2 to 6 of carbon atoms, $R_{12}$ and $R_{13}$ each represent a hydrogen atom, an alkyl group having 1 to 6 carbon atoms, a hydroxyalkyl group having 2 to 6 of carbon atoms, a benzyl group, or formula

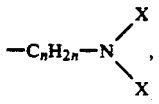

(wherein n is an integer of 1 to 6, and X and X' each represent a hydrogen atom, an alkyl group having 1 to 6 carbon atoms, a hydroxyalkyl group having 2 to 6 of carbon atoms). Preferable examples of compound represented by formula (A) are as follows:

(A-1): ethanolamine
(A-2): diethanolamine
(A-3): triethanolamine
(A-4): di-isopropanolamine
(A-5): 2-methylaminoethanol
(A-6): 2-ethylaminoethanol
(A-7): 2-dimethylaminoethanol
(A-8): 2-diethylaminoethanol
(A-9): 1-diethylamino-2-propanol
(A-10): 3-diethylamino-1-propanol
(A-11): 3-dimethylamino-1-propanol
(A-12): isopropylaminoethanol
(A-13): 3-amino-1-propanol
(A-14): 2-amino-2-methyl-1,3-propandiol
(A-15): ethylenediaminetetraisopropanol
(A-16): benzyldiethanolamine
(A-17): 2-amino-2-(hydroxymethyl)-1,3-propandiol
(A-18): 1,3-diaminopropanol
(A-19): 1,3-bis(2-hydroxyethylmethylamino)-propanol These compounds represented by the above formula (A) are, in view of the effect of the present invention, used preferably in an amount of 3 g to 100 g, and more preferably in an amount of 6 g to 50 g, per liter of the color developer.

In the color-developer according to the present invention, a compound represented by formulae (B-I) and (B-II) shown below is more preferably used in view of restraint of deterioration of the developer.

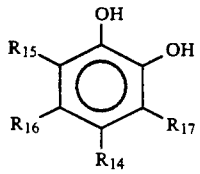
Formula (B-I)

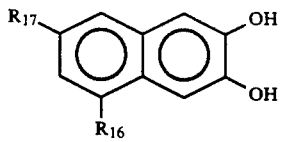
Formula (B-II)

wherein $R_{14}$, $R_{15}$, $R_{16}$, and $R_{17}$, each represent a hydrogen atom, a halogen atom, a sulfonic group, an alkyl group having 1 to 7 carbon atoms, —$OR_{18}$, —$COOR_{19}$,

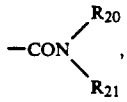

or phenyl group; and $R_{18}$, $R_{19}$, $R_{20}$, and $R_{21}$ each represent a hydrogen atom, an alkyl group having 1 to 18 carbon atoms, provided that when $R_{15}$ represents —OH or a hydrogen atom, $R_{14}$ represents a halogen atom, sulfonic group, an alkyl group having 1 to 7 carbon atoms, —$OR_{18}$, —$COOR_{19}$,

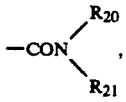

or a phenyl group.

Alkyl group represented by the above-described $R_{14}$, $R_{15}$, $R_{16}$, and $R_{17}$ include those having a substituent, and examples thereof that can be mentioned include, for example, methyl group, ethyl group, iso-propyl group, n-propyl group, t-butyl group, n-butyl group, hydroxymethyl group, hydroxyethyl group, methylcarbonic acid group, and benzyl group. Alkyl group represented by $R_{18}$, $R_{19}$, $R_{20}$, and $R_{21}$, has the same meaning as the above and further octyl group can be included.

As phenyl group represented by $R_{14}$, $R_{15}$, $R_{16}$, and $R_{17}$ phenyl group, 2-hydroxyphenyl group, and 4-amino-phenyl group can be mentioned.

Representative examples of the chelating agent of the preset invention are shown below, but the invention is not limited to them.

(B-I-1): 4-isopropyl-1,2-dihydroxybenzene
(B-I-2): 1,2-dihydroxybenzene-3,5-disulfonic acid
(B-I-3): 1,2,3-trihydroxybenzene-5-carbonic acid
(B-I-4): 1,2,3-trihydroxybenzene-5-carboxymethyl ester
(B-I-5): 1,2,3-trihydroxybenzene-5-carboxy-n-butyl ester
(B-I-6): 5-t-butyl-1,2,3-trihydroxybenzene
(B-I-7): 1,2-dihydroxybenzene-3,4,6-trisulfonic acid
(B-II-1): 2,3-dihydroxynaphthalene-6-sulfonic acid
(B-II-2): 2,3,8-trihydroxynaphthalene-6-sulfonic acid
(B-II-3): 2,3-dihydroxynaphthalene-6-carbonic acid
(B-II-4): 2,3-dihydroxy-8-isopropyl-naphthalene
(B-II-5): 2,3-dihydroxy-8-chloro-naphthalene-6-sulfonic acid Of the above-mentioned compounds, one that can be used preferably in particular in the present invention is 1,2-dihydroxybenzene-3,5-disulfonic acid, which may be used as the form of alkaline salt such as sodium salt and potassium salt (exemplified compound (B-I-2)).

In the present invention, compound represented by the above formulae (B-I) or (B-II) may be used in the range of 5 mg to 15 g, preferably 15 mg to 10 g, more preferably 25 mg to 7 g, per liter of color developer.

Preferably the pH of the color developer of the present invention is in the rang of 9 to 12, more preferably 9 to 11.0, and other known compounds that are components of a conventional developing solution can be contained.

In order to keep the above pH, it is preferable to use various buffers. As buffers, there are included sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate).

The amount of buffer to be added to the color developer is preferably 0.1 mol/l or more, and particularly preferably 0.1 to 0.4 mol/l.

In addition to the color developer can be added various chelating agents to prevent calcium or magnesium from precipitating or to improve the stability of the color developer. Specific examples are shown below, but the present invention is not limited to them: nitrilotriacetic acid, diethylenediaminepentaacetic acid, ethylenediaminetetraacetic acid, triethylenetetraminehexaacetic acid, nitrilo-N,N,N-tris(methylenephosphonic acid), ethylenediamine-N,N,N',N'-tetrakis(methylenesulfonic acid), 1,3-diamino-2-propanoltetraacetic acid, transcyclohexanediaminetetraacetic acid, nitrilotripropionic acid, 1,2-diaminopropanetetraacetic acid, hydroxyethyliminodiacetic acid, glycol ether diaminetetraacetic acid, hydroxyethylenediaminetriacetic acid, ethylenediamine-ortho-hydroxyphenyltetraacetic acid, 2-phosphonobutane-1,2,4-tricarboxylic acid, 1-hydroxyethylidene-1,1-diphosphonic acid, N,N'-bis(2-hydroxybenzyl)ethylenediamine-N,N'-diacetic acid, catechol-3,4,6-trisulfonic acid, catechol-3,5-disulfonic acid, 5-sulfosalicylic acid, and 4-sulfosalicylic acid.

Of these chelating agents, ethylendiaminetetraacetic acid, diethylenediaminepentaacetic acid, triethylenetetraminehexaacetic acid, 1-3-diamino-2-propanoltetraacetic acid, ethylenediamine-N,N,N',N'-tetrakis(methylenephosphonic acid), and hydroxyiminodiacetic acid are preferably used.

If necessary, two or more of these chelating agents may be used together.

With respect to the amount of these chelating agents to be added to the color developer, it is good if the amount is enough to sequester metal ions in the color developer. The amount, for example, is on the order of 0.1 g to 10 g per liter.

If necessary, any development accelerator can be added to the color developer.

As development accelerators, the following can be added as desired: thioether compounds disclosed, for example, in JP-B Nos. 16088/1962, 5987/1962, 7826/1962, 12380/1969, and 9019/1970, and U.S. Pat. No. 3,813,247; p-phenylenediamine compounds disclosed in JP-A Nos. 49829/1977 and 15554/1975; quaternary ammonium salts disclosed, for example, in JP-A No. 137726/1975, JP-B No. 30074/1969, and JP-A Nos. 156826/1981 and 43429/1977; p-aminophenols disclosed, for example, in U.S. Pat. Nos. 2,610,122 and 4,119,462; amine compounds disclosed, for example, in U.S. Pat. Nos. 2,494,903, 3,128,182, 4,230,796, and 3,253,919, JP-B No. 11431/1966, and U.S. Pat. Nos. 2,482,546, 2,596,926, and 3,582,346; polyalkylene oxides disclosed, for example, in JP-B Nos. 16088/1962 and 25201/1967, U.S. Pat. No. 3,128,183, JP-B Nos. 11431/1966 and 23883/1967, and U.S. Pat. No. 3,532,501; 1-phenyl-3-pyrazolidones, mesoionic type compounds, ionic type compounds, and imidazoles.

It is preferable that the color developer of the present invention is substantially free from benzyl alcohol in view of prevention of edge stain. Herein the term "substantially free from" means that the amount of benzyl alcohol is 2.0 ml or below per liter of the developer, or preferably benzyl alcohol is not contained in the developer at all. It is particularly preferable to be substantially free from benzyl alcohol in view of prevention of edge stain.

For the purpose of preventing fogging or the like, particularly in the processing a high-silver-chloride photographic material containing 80 mol % or over of silver chloride, it is preferable that chloride ions and bromide ions exist in the color developer. Preferably chloride ions are contained in an amount of $1.0\times10^{-2}$ to $1.5\times10^{-1}$ mol/l, more preferably $4.0\times10^{-2}$ to $1.0\times10^{-1}$ mol/l. If the concentration of ions exceeds $1.5\times10^{-1}$ mol/l, development is made disadvantageously slow. On the other hand, if the concentration of chloride ions is less than $1.0\times10^{-2}$ mol/l, fogging is not prevented.

The color developer contains bromide ions preferably in an amount of $3.0\times10^{-5}$ to $1.0\times10^{-3}$ mol/l. More preferably bromide ions are contained in an amount $5.0\times10^{-5}$ to $5.0\times10^{-4}$ mol/l, most preferably $1.0\times10^{-4}$ to $3.0\times10^{-4}$ mol/l. If the concentration of bromide ions is more than $1.0\times10^{-3}$ mol/l, the development is made slow, the maximum density and the sensitivity are made low, and if the concentration of bromide ions is less than $3.0\times10^{-5}$ mol/l, fogging is not prevented.

Herein, chloride ions and bromide ions may be added directly to the developer, or they may be allowed to dissolve out from the photographic material in the developer.

If chloride ions are added directly to the color developer, as the chloride ion-supplying material can be mentioned sodium chloride, potassium chloride, ammonium chloride, lithium chloride, nickel chloride, magnesium chloride, manganese chloride, calcium chloride, and cadmium chloride, with sodium chloride and potassium chloride preferred.

Chloride ions and bromide ions may be supplied from a brightening agent as the form of its counter ion that will be added to the developer. As the bromide ion-supplying material can be mentioned sodium bromide, potassium bromide, ammonium bromide, lithium bromide, calcium bromide, magnesium bromide, manganese bromide, nickel bromide, cadmium bromide, cerium bromide, and thallium bromide, with potassium bromide and sodium bromide preferred.

When chloride ions and bromide ions are allowed to dissolve out from the photographic material in the developer, both the chloride ions and bromide ions may be supplied from the emulsion or a source other than the emulsion.

In the present invention, if necessary, any antifoggant can be added in addition to chloride ion and bromide ion. As antifoggants, use can be made of alkali metal halides, such as potassium iodide, and organic antifoggants. As typical organic antifoggants can be mentioned, for example, nitrogen-containing heterocyclic compounds, such as benzotriazole, 6-nitrobenzimidazole, 5-nitroisoindazole, 5-methylbenzotriazole, 5-nitrobenzotriazole, 5-chloro-benzotriazole., 2-thiazolylbenzimidazole, 2-thiazolylmethyl-benzimidazole, indazole, hydroxyazaindolizine, and adenine.

It is preferable that the color developer used in the present invention contains a brightening agent. As the brightening agent, 4,4'-diamino-2,2'-disulfostilbene compounds are preferable, which will be added in an amount of 0 to 10 g/l, preferably 0.1 to 6 g/l.

If required, various surface-active agents, such as alkylsulfonic acids, arylphosphonic acids, aliphatic carboxylic acids, and aromatic carboxylic acids may be added.

The processing time with the color developer for use in the present invention is, for example, 10 to 120 sec., preferably 20 to 60 sec., in which effects of the present invention being remarkable. The processing temperature is 33° to 45° C., and preferably 36° to 40° C., under such conditions the effect of the present invention is particularly remarkable.

The amount of the replenisher of the color developer during continuous processing is 20 to 220 ml, preferably 25 to 160 ml, and particularly preferably 30 to 110 ml, per 1 $m^2$ of the photographic material, which is preferable because the effect of the present invention can be exhibited efficiently.

The color developer of the present invention has relatively better performance than that obtained by combinations other than the combination of the present invention, even if the opened surface ratio of the color developer (the air contact surface area ($cm^2$)/the solution volume ($cm^3$)) is in any state. Preferably the opened surface ratio is 0 to 0.1 $cm^{-1}$ in view of the stability of the color developer. In the continuous processing, preferably, in practice, the opened surface ratio is in the range of 0.001 to 0.05 $cm^{-1}$, more preferably 0.002 to 0.03 $cm^{-1}$.

Generally when hydroxylamine or the like is used as a preservative, it is widely known that even if the liquid opening rate of the color developer is made small, decomposition of the color developer due to heat or trace metals takes place. However, in the present color developer, such decomposition is very little, and the color developer can be stored for a long period of time or can practically be well used continuously for a long period of time without difficulty. Therefore, in such a case, preferably the opened surface ratio is smaller, and most preferably the opened surface ratio is 0 to 0.002 $cm^{-1}$.

Conversely, there is a method wherein a large opened surface ratio is used, provided that after a certain amount of a photographic material is processed, the processing solution is discarded, and even in such a processing method, the constitution according to the present invention can exhibit excellent performance.

In the present invention desilvering is effected after color development. The desilvering step generally consists of a bleaching step and a fixing step, and particularly preferably the bleaching step and the fixing step are carried out simultaneously.

Further, the bleaching solution or the bleach-fixing solution used in the present invention can contain rehalogenation agents, such as bromides (e.g., potassium bromide, sodium bromide, and ammonium bromide), chlorides (e.g., potassium chloride, sodium chloride, and ammonium chloride), or iodides (e.g., ammonium iodide). If necessary the bleaching solution or the bleach-fixing solution can contain, for example, one or more inorganic acids and organic acids or their alkali salts or ammonium salts having a pH-buffering function, such as borax, sodium metaborate, acetic acid, sodium acetate, sodium carbonate, potassium carbonate, phosphorous acid, phosphoric acid, sodium phosphate, citric acid, sodium citrate, and tartaric acid, and ammonium nitrate, and guanidine as a corrosion inhibitor.

The fixing agent used in the bleach-fixing solution or the fixing solution according to the present invention can use one or more of water-soluble silver halide solvents, for example thiosulfates, such as sodium thiosulfate and ammonium thiosulfate, thiocyanates, such as sodium thiocyanate and ammonium thiocyanate, thiourea compounds and thioether compounds, such as ethylenebisthioglycolic acid and 3,6-dithia-1,8-octanediol. For example, a special bleach-fixing solution comprising a combination of a fixing agent described in JP-A No. 155354/1980 and a large amount of a halide, such as potassium iodide, can be used. In the present invention, it is preferable to use thiosulfates, and particularly ammonium thiosulfate. The amount of the fixing agent per liter is preferably 0.3 to 2 mol, and more preferably 0.5 to 1.0 mol.

The pH range of the bleach-fixing solution or the fixing solution is preferably 3 to 8, and particularly preferably 4 to 7. If the pH is lower than this range, the desilvering is improved, but the deterioration of the solution and the leucolization of cyan dye are accelerated. In reverse, if the pH is higher than this range, the desilvering is retarded and stain is liable to occur.

To adjust pH, if necessary, a compound such as hydrochloric acid, sulfuric acid, nitric acid, acetic acid, bicarbonate, ammonia, caustic potassium, caustic soda, sodium carbonate and potassium carbonate may be added.

Further, the bleach-fixing solution may additionally contain various brightening agents, anti-foaming agents, surface-active agents, polyvinyl pyrrolidone, and organic solvents, such as methanol.

The bleach-fixing solution or the fixing solution used in the present invention contains, as a preservative, sulfites (e.g., sodium sulfite, potassium sulfite, and ammonium sulfite), bisulfites (e.g., ammonium bisulfite, sodium bisulfite, and potassium bisulfite), and methabisulfites (e.g., potassium metabisulfite, sodium metabisulfite, and ammonium metabisulfite). Preferably these compounds are contained in an amount of 0.02 to 0.50 mol/l, and more preferably 0.04 to 0.40 mol/l, in terms of sulfite ions.

As a preservative, generally a bisulfite is added, but other compounds, such as ascorbic acid, carbonyl bisulfite addition compound, sulfinic acid, sulfinic acid, or carbonyl compounds, may be added.

If required, for example, buffers, brightening agents, chelating agents, and mildew-proofing agents may be added.

The processing time by the bleach-fixing solution of the present invention is in the range of 10 to 120 sec., preferably 20 to 60 sec., and the replenishing amount of the bleach-fixing solution is in the rage of 30 to 250 ml, preferably 40 to 150 ml, per square meter of photographic material. While it is generally liable to increase stain and occur an insufficient desilvering accompanying with the decrease of replenishing amount, the decrease of replenishing amount without these problems can be made according to the present invention.

The silver halide color photographic material used in the present invention is generally washed and/or stabilized after the fixing or the desilvering, such as the bleach-fixing.

The amount of washing water in the washing step can be set over a wide range, depending on the characteristics of the photographic material (e.g., the characteristics of the materials used, such as couplers), the application of the photographic material, the washing water temperature, the number of the washing water tanks (stages), the type of replenishing (i.e., depending on whether the replenishing is of the countercurrent type or of the down flow type), and other various conditions. The relationship between the number of washing water tanks and the amount of water in the multi-stage countercurrent system can be determined based on the method described in *Journal of the Society of Motion Picture and Television* Engineers, Vol. 64, pp. 248 to 253 (May 1955).

According to the multi-stage countercurrent system, the amount of washing water can be reduced considerably. But a problem arises that bacteria can propagate due to the increase in the residence time of the water in the tanks, and the suspended matter produced will adhere to the photographic material. To solve such a problem in processing the color photographic material of the present invention, the process for reducing calcium and magnesium described in JP-A No. 288838/1987 can be used quite effectively. Further, isothiazolone compounds and thiabendazoles described in JP-A No. 8542/1982, chlorine-type bactericides, such as sodium chlorinated isocyanurates described in JP-A No. 120145/1986, benzotriazoles described in JP-A No. 267761/1986, copper ions, and bactericides described by Hiroshi Horiguchi in *Bokin Bobai-zai no Kagaku, Biseibutsu no Genkin, Sakkin, Bobai Gijutsu* (edited by Eiseigijutsu-kai), and *Bokin Bobai-zai Jiten* (edited by Nihon Bokin Bobai-gakkai), can be used.

The pH range of the washing water in the processing steps for the photographic material of the present invention may be 4 to 9, preferably 5 to 8. The temperature and time of washing, which can be set according to the use or property of the photographic material, is generally in the range 15° to 45° C. and 20 sec. to 2 min., preferably 25° to 40° C. and 30 sec. to 1 min.

According to the present invention good photographic properties without the increasing of stain can be obtained even if processing by such short-time washing.

Further, the photographic materials of the present invention can be processed directly by a stabilizing solution without a washing step. In such a stabilizing process, all known methods described, for example, in JP-A Nos. 8543/1982, 14834/1983, 184343/1984, 220345/1985, 238832/1985, 239784/1985, 239749/1985, 4045/1986, and 118749/1986 can be used. A preferred inclusion is to use a stabilizing bath containing 1-hydroxyethylidene-1,1-diphosphonate, 5-chloro-2-methyl-4-isothiazolone-3-one, a bismuth compound, or an ammonium compound.

In some cases a stabilizing process is carried out following the above-described washing process, and an example of such cases is a stabilizing bath containing formalin and a surface-active agent for use as a final bath for color photographic materials for photographing.

The time of the processing steps of the present invention is defined as the period from the time when the photographic material is brought in contact with the color developer to the time when the photographic material leaves the final bath (which is generally a washing bath or a stabilizing bath), and the effect of the present invention can be exhibited remarkably in rapid processing steps wherein the time of those processing steps is 3 min 30 sec or below, preferably 3 min or below.

Now, the silver halide photographic material whose base is prepared by coating the both sides of base paper with a polyolefin will be described.

In the present invention, the base paper for the base contains, based on the oven-dry weight of the pulp in the paper, at least one of:

- epoxidized higher aliphatic acid amides in an amount of 0.01 wt. % or over, preferably 0.01 to 1 wt. %, and particularly preferably 0.1 to 0.7 wt. %,
- alkylketene dimers in an amount of 0.05 wt. % or over, preferably 0.05 to 2 wt. %, and more preferably 0.3 to 1.5 wt. %,
- higher aliphatic acid salts in an amount of 0.1 wt. % or over, preferably 0.1 to 3 wt. %, and more preferably 0.5 to 2 wt. %,
- and alkenyl succinic anhydride in an amount of 0.1 wt. % or over, preferably 0.1 to 2 wt. %, and more preferably 0.3 to 1.5 wt. %,
- and thus the present invention achieves the prevention of edge stain when the photographic material is processed with the above developing solution.

Two or more, even all four kinds, of these additives for base paper may be used together.

As the epoxidized higher aliphatic acid amides, conventional one can be used. Particularly, compounds having the structure represented by the following formula are preferable:

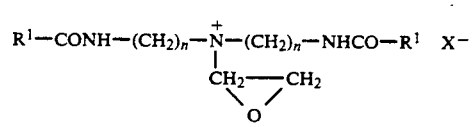

wherein $R^1$ represents a substituent such as an alkyl group, n is a positive integer, and X represents an anion. The carbon number of $R^1$ is 12 or more, preferably 4 to 22, more preferably 16 to 21. Examples thereof include NS-715 (tradename, manufactured by Kindaikagaku).

As the alkylketene dimers, conventional compounds can be used, and particularly, compounds having the structure represented by the following formula are preferable:

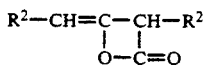

wherein $R^2$ represents an alkyl group having 12 or more carbon atoms, preferably 14 to 22 carbon atoms, more preferably 16 to 21 carbon atoms, such as hexadecyl, octadecyl, eicosyl, and docosyl. Examples thereof include Acopale 12, Harkon W, and Harkon 602 (tradenames, manufactured by DIC-Hercules Co.), Saisen H20 (tradename, manufactured by KaO Co.) and SPK-903 (tradename, manufactured by Arakawa Chemicals Co.).

As the higher aliphatic acid salts, any compounds known in the art can be used. Particularly, alkali metal salts of saturated acids (e.g., sodium salts or potassium salts of hexadecanoic acid, heptadecanoic acid, octadecanoic acid, eicosanoic acid, stearic acid, and docosanoic acid) can be mentioned. Herein "higher aliphatic acid" means an aliphatic acid having 12 or more, preferably 14 to 22, more preferably 16 to 21, of total carbon atoms.

As the alkenyl succinic anhydrides, conventional compounds can be used, and particularly compounds represented by the following formula are preferable:

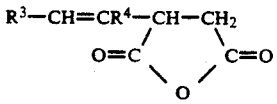

wherein $R^3$ represents a substituent such as an alkyl group, and $R^4$ represents a divalent group such as an alkynyl group. Carbon numbers of $R^3$ and $R^4$ each are 12 or more, preferably 14 to 22, and more preferably 16 to 21. Examples thereof include Size-pine SA-850 and Size-pine SA-810 (tradename, manufactured by Arakawa Chemcals Co.) and RS-168E (tradename, manufactured by Sanyo Kasei Co.).

The effect of the present invention can be attained remarkably, in particular, by using alkylketene dimer.

These additives can be added by means of mixing into the pulp when the base paper is made.

The base paper used in the present invention is made by using mainly wood pulp, such as softwood and hardwood bleached kraft pulp, and softwood and hardwood bleached sulfite pulp, to which synthetic fibers, such as vinylon (polyvinyl alcohol series synthetic fiber), or a synthetic pulp, such as polyethylene, may be added. Preferably the freeness of the pulp is 200 to 350 CSF, taking the sheet-formation and paper making aptitude into consideration.

In the present invention, in addition to the above additives, if necessary, a filler, such as clay, talc, calcium carbonate, and urea resin fine particles, a sizing agent, such as rosin and paraffin wax, a dry-strength additive, such as polyacrylamide, and a retention agent, such as aluminum sulfate and cationic polymers, may be added.

Preferably the surface of the base paper is sufacesized with a film-forming polymer, such as gelatin, starch, carboxymethylcellulose, polyacrylamide, polyvinyl alcohol, and a modified polyvinyl alcohol, particularly preferably with polyvinyl alcohol or a modified polyvinyl alcohol. As the modified polyvinyl alcohol, carboxy-modified polyvinyl alcohol, silanol-modified polyvinyl alcohol, and polyvinyl alcohol copolyers with acrylamide can be mentioned. The coating amount of the coating polymer is 0.1 to 5.0 g/m$^2$, preferably 0.5 to 3.0 g/m$^2$. If necessary, in addition to the coating polymer, an antistatic agent, a brightening agent, pigments, an antifoamer, and a compound having a cation can also be included in the surface sizing.

As facilities for making paper that are used in the present invention, a common Fourdrinier paper machine can be used, which is preferably equipped with calenders before the size-press and the winder of the paper machine.

The basis-weight and thickness of the paper of the waterproof base of the present invention are 60 g/m$^2$ to 230 g/m$^2$ and 55 $\mu$m to 230 $\mu$m, respectively.

As the polyolefin resin that is used to coat the opposite surfaces of base paper, for example, $\alpha$-olefin homopolymers, such as polyethylene and polypropylene, and mixtures of these polymers can be mentioned. Particularly preferable polyolefins are high-density polyethylene, low-density polyethylene, and mixtures thereof. These polyolefins are used to coat the opposite surfaces of base paper by the extrusion coating process, and therefore there is no particular limit on the molecular weight of the polyolefins as long as the extrusion coating is possible, but generally polyolefins having a molecular weight in the range of $10^4$ to $10^6$ may be used.

There is no particular limit on the thickness of the polyolefin coating layer, and it can be determined as for the thickness of a conventional polyolefin coat layer of a base for printing paper, although preferably in general the thickness of the polyolefin coat layer is 10 to 50 $\mu$m.

As the polyolefin coating layer on the surface of paper, that is, on the side where photographic emulsions will be applied, one containing a white pigment is preferable, and for example the type of the white pigment and the amount thereof to be incorporated can suitably be selected in a known manner. Further, such known additives as brightening agents and antioxidants can be added.

The polyolefin coat layer on the other side may consist of only the above polyolefin resin, but a coloring pigment, a white pigment, and the like may be added thereto, or said polyolefin coat layer may contain the same additives as those added to the above-mentioned polyolefin coat layer on the face.

As the extrusion coating facilities for extrusion coating of the polyolefin, a common extruder and laminator for polyolefins are used.

To provide silver halide emulsion layers on the polyolefin coat layer, the polyolefin coat layer surface is subjected to corona discharge treatment, glow discharge treatment, flame treatment, or the like. Then, if necessary, the surface is provided with a primer coat layer and an antihalation coating, and silver halide emulsion layers may be applied.

Now the color photographic material to be used in the present invention will be described in detail.

The color photographic material of the present invention can be constituted by applying at least each of a blue-sensitive silver halide emulsion layer, a green-sensitive silver halide emulsion layer, and a red-sensitive silver halide emulsion layer on a base. For common color print papers, the above silver halide emulsion layers are applied in the above-stated order on the base, but the order may be changed. Color reproduction by the subtractive color process can be performed by incorporating, into these photosensitive emulsion layers, silver halide emulsions sensitive to respective wavelength ranges, and so-called colored-couplers capable of forming dyes complementary to light to which the couplers are respectively sensitive, that is, capable of forming yellow complementary to blue, magenta complementary to green, and cyan complementary to red. However, the constitution may be such that the photosensitive layers and the color formed from the couplers do not have the above relationship.

In the present invention, the coating amount of silver halide is 1.5 $g/m^2$ or less, preferably 0.8 $g/m^2$ or less and 0.3 $g/m^2$ or more, in terms of silver. A coating amount of 0.8 $g/m^2$ or less is very preferable in view of rapidness, processing-stability, and storage-stability of image after processing (in particular, restraint of yellow stain). Further, the coating silver amount is preferably 0.3 $g/m^2$ or over, in view of image-density. From these points of view the coating amount of silver halide in terms of silver is more preferably 0.3 to 0.75 $g/m^2$, particularly preferably 0.4 to 0.7 $g/m^2$.

As the silver halide emulsion used in the present invention, one comprising silver chlorobromide or silver chloride and being substantially free from silver iodide can be preferably used. Herein the term "substantially free from silver iodide" means that the silver iodide content is 1 mol % or below, and preferably 0.2 mol % or below. Although the halogen compositions of the emulsions may be the same or different from grain to grain, if emulsions whose grains have the same halogen composition are used, it is easy to make the properties of the grains homogeneous. With respect to the halogen composition distribution in a silver halide emulsion grain, for example, a grain having a so-called uniform-type structure, wherein the composition is uniform throughout the silver halide grain, a grain having a so-called layered-type structure, wherein the halogen composition of the core of the silver halide grain is different from that of the shell (which may comprises a single layer or layers) surrounding the core, or a grain having a structure with nonlayered parts different in halogen composition in the grain or on the surface of the grain (if the nonlayered parts are present on the surface of the grain, the structure has parts different in halogen composition joined onto the edges, the corners, or the planes of the grain) may be suitably selected and used. To secure high sensitivity, it is more advantageous to use either of the latter two than to use grains having a uniform-type structure, which is also preferable in view of the pressure resistance. If the silver halide grains have the above-mentioned structure, the boundary section between parts different in halogen composition may be a clear boundary, or an unclear boundary, due to the formation of mixed crystals caused by the difference in composition, or it may have positively varied continuous structures.

As to the silver halide composition of these silver chlorobromide emulsions, the ratio of silver bromide/silver chloride can be selected arbitrarily. That is, the ratio is selected from the broad range in accordance with the purpose, but the ratio of silver chloride in a silver chlorobromide is preferably 2% or over.

Further in the photographic material suitable for a rapid processing a emulsion of high silver chloride content, so-called a high-silver-chloride emulsion may be used preferably. The content of silver chloride of the high-silver-chloride emulsion is preferably 90 mol % or over, more preferably 95 mol % or over.

In these high-silver-chloride emulsions, the structure is preferably such that the silver bromide localized layer in the layered form or nonlayered form is present in the silver halide grain and/or on the surface of the silver halide grain as mentioned above. The silver bromide content of the composition of the above-mentioned localized layer is preferably at least 10 mol %, and more preferably over 20 mol %. The localized layer may be present in the grain, or on the edges, or corners of the grain surfaces, or on the planes of the grains, and a preferable example is a localized layer epitaxially grown on each corner of the grain.

On the other hand, for the purpose of suppressing the lowering of the sensitivity as much as possible when the photographic material undergoes pressure, even in the case of high-silver-chloride emulsions having a silver chloride content of 90 mol % or over, it is preferably also practiced to use grains having a uniform-type structure, wherein the distribution of the halogen composition in the grain is small.

In order to reduce the replenishing amount of the development processing solution, it is also effective to increase the silver chloride content of the silver halide emulsion. In such a case, an emulsion whose silver chloride is almost pure, that is, whose silver chloride content is 98 to 100 mol %, is also preferably used.

The average grain size of the silver halide grains contained in the silver halide emulsion used in the present invention (the diameter of a circle equivalent to the projected area of the grain is assumed to be the grain size, and the number average of grain sizes is assumed to be an average grain size) is preferably 0.1 to 2 μm.

Further, the grain size distribution thereof is preferably one that is a so-called monodisperse dispersion, having a deviation coefficient (obtained by dividing the standard deviation of the grain size by the average grain size) of 20% or below, and desirably 15% or below. In this case, for the purpose of obtaining one having a wide latitude, it is also preferable that monodisperse emulsions as mentioned above are blended to be used in the same layer, or are applied in layers.

As to the shape of the silver halide grains contained in the photographic emulsion, use can be made of grain in a regular crystal form, such as cubic, tetradecahedral, or octahedral, or grains in an irregular crystal form, such as spherical or planar, or grains that are a composite of these. Also, a mixture of silver halide grains having various crystal forms can be used. In the present invention, of these, grains containing grains in a regular crystal form in an amount of 50% or over, preferably 70% or over, and more preferably 90% or over, are preferred.

Further, besides those mentioned above, an emulsion wherein the tabular grains having an average aspect ratio (the diameter of a circle calculated/the thickness) of 5 or over, and preferably 8 or over, exceed of the total of the grains in terms of the projected area, can be preferably used.

The silver chloromide emulsion used in the present invention can be prepared by methods described, for example, by P. Glafkides, *in Chimie et Phisique Photographique* (published by Paul Montel, 1967), by G. F. Duffin in *Photographic Emulsion Chemistry* (published by Focal Press, 1966), and by V. L. Zelikman et al. in *Making and Coating Photographic Emulsion* (published by Focal Press, 1964). That is, any of the acid process, the neutral process, the ammonia process, etc. can be used, and to react a soluble silver salt and a soluble halide, for example, any of the single-jet process, the double-jet process, or a combination of these can be used. A process of forming grains in an atmosphere having excess silver ions (the so-called reverse precipitation process) can also be used. A process wherein the pAg in the liquid phase where a silver halide is to be formed is kept constant, that is, the so-called controlled double-jet process, can be used as one type of double-jet process. According to the controlled double-jet process, a silver halide emulsion wherein the crystal form is regular and the grain sizes are nearly uniform can be obtained.

Into the silver halide emulsion used in the present invention, various polyvalent metal ion impurities can be introduced during the formation or physical ripening of the emulsion grains. Examples of such compounds to be used include salts of cadmium, zinc, lead, copper, and thallium, and salts or complex salts of an element of Group VIII, such as iron, ruthenium, rhodium, palladium, osmium, iridium, and platinum. Particularly the elements of Group VIII can be preferably used. Although the amount of these compounds to be added varies over a wide range according to the purpose, preferably the amount is $10^{-9}$ to $10^{-2}$ mol for the silver halide.

The silver halide emulsion used in the present invention is generally chemically sensitized and spectrally sensitized.

As the chemical sensitization method, sulfur sensitization, wherein typically an unstable sulfur compound is added, noble metal sensitization, represented by gold sensitization, or reduction sensitization can be used alone or in combination. As the compounds used in the chemical sensitization, preferably those described in JP-A No. 215272/1987, page 18 (the right lower column) to page 22 (the right upper column), are used.

The spectral sensitization is carried out for the purpose of providing the emulsions of the layers of the photographic material of the present invention with spectral sensitivities in desired wavelength regions. In the present invention, the spectral sensitization is preferably carried out by adding dyes that absorb light in the wavelength ranges corresponding to the desired spectral sensitivities, that is, by adding spectrally sensitizing dyes. As the spectrally sensitizing dyes used herein, for example, those described by F. M. Harmer in *Heterocyclic compounds—Cyanine dyes and related compounds* (published by John Wiley & Sons [New York, London], 1964) can be mentioned. As specific examples of the compounds and the spectral sensitization method, those described in the above JP-A No. 215272/1987, page 22 (the right upper column) to page 38, are preferably used.

In the silver halide emulsion used in the present invention, various compounds or their precursors can be added for the purpose of stabilizing the photographic performance or preventing fogging that will take place during the process of the production of the photographic material, or during the storage or photographic processing of the photographic material. As specific examples of these compounds, those described in the above-mentioned JP-A No. 215272/1987, pages 39 to 72, are preferably used.

As the emulsion used in the present invention, use is made of a so-called surface-sensitive emulsion, wherein a latent image is formed mainly on the grain surface, or of a so-called internal-image emulsion, wherein a latent image is formed mainly within the grains.

When the present invention is used for color photographic materials, generally in the color photographic material are used a yellow coupler, a magenta coupler, and a cyan coupler, which will couple with the oxidized product of the aromatic amine color-developing agent to form yellow, magenta, and cyan.

Cyan couplers, magenta couplers, and yellow couplers preferably used in the present invention are those represented by the following formulae (C-1), (C-II), (M-I), (M-II), and (Y):

Formula (C-I)

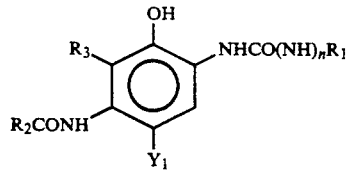

Formula (C-II)

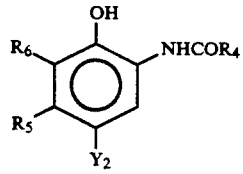

Formula (M-I)

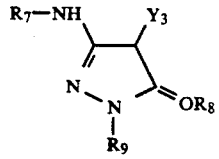

Formula (M-II)

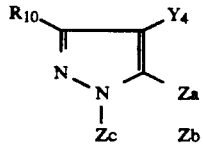

Formula (Y)

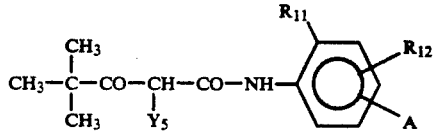

In formulae (C-I) and (C-II), $R_1$, $R_2$, and $R_4$ each represent a substituted or unsubstituted aliphatic, aromatic, or heterocyclic group, $R_3$, $R_5$, and $R_6$ each represent a hydrogen atom, a halogen atom, an aliphatic group, an aromatic group, or an acylamino group, $R_3$ and $R_2$ together may represent a group of nonmetallic atoms to form a 5- or 6-membered ring, $Y_1$ and $Y_2$ each represent a hydrogen atom or a group that is capable of coupling off with the oxidation product of a developing agent, and n is 0 or 1.

In formula (C-II), $R_5$ preferably represents an aliphatic group such as a methyl group, an ethyl group, a propyl group, a butyl group, a pentadecyl group, a tert-butyl group, a cyclohexyl group, a cyclohexylmentyl group, a phenylthiomethyl group, a dodecyloxyphenylthiomethyl group, a butaneamidomethyl group, and a methoxymethyl group.

Preferable examples of the cyan couplers represented by formulae (C-I) and (C-II) are given below:

In formula (C-I), preferable $R_1$ is an aryl group or a heterocyclic group, and more preferably an aryl group substituted by a halogen atom, an alkyl group, an alkoxy group, an aryloxy group, an acylamino group, an acyl group, a carbamoyl group, a sulfonamido group, a sulfamoyl group, a sulfonyl group, a sulfamido group, an oxycarbonyl group, or a cyano group. T In formula (C-I), when $R_3$ and $R_2$ together do not form a ring, $R_2$ is preferably a substituted or unsubstituted alkyl group, or aryl group, and particularly preferably an alkyl group substituted by a substituted aryloxy, and preferably $R_3$ represents a hydrogen atom.

In formula (C-II), preferable $R_4$ is a substituted or unsubstituted alkyl group or aryl group, and particularly preferably an alkyl group substituted by a substituted aryloxy group.

In formula (C-II), preferable $R_5$ is an alkyl group having 2 to 15 carbon atoms, or a methyl group substituted by a substituent having 1 or more carbon atoms, and the substituent is preferably an arylthio group, an alkylthio group, an acylamino group, an aryloxy group, or an alkyloxy group.

In formula (C-II), preferably $R_5$ is an alkyl group having 2 to 15 carbon atoms, and particularly preferably an alkyl group having 2 to 4 carbon atoms.

In formula (C-II), preferable $R_6$ is a hydrogen atom or a halogen atom, and particularly preferably a chlorine atom or a fluorine atom. In formulae (C-I) and (C-II), preferable $Y_1$ and $Y_2$ each represent a hydrogen atom, a halogen atom, an alkoxy group, an aryloxy group, an acyloxy group, or a sulfonamido group.

In formula (M-I), $R_7$ and $R_9$ each represent an aryl group, $R_8$ represents a hydrogen atom, an aliphatic or aromatic acyl group, an aliphatic or aromatic sulfonyl group, and $Y_3$ represents a hydrogen atom or a coupling split-off group. Allowable substituents of the aryl group represented by $R_7$ and $R_9$ are the same substituents as those allowable for the substituent $R_1$, and if there are two substituents, they may be the same or different. $R_8$ is preferably a hydrogen atom, an aliphatic acyl group, or a sulfonyl group, and particularly preferably a hydrogen atom. Preferable $Y_3$ is of the type that will split-off at one of a sulfur atom, an oxygen atom, and a nitrogen atom, and particularly preferably of the sulfur atom split-off type described, for example, in U.S. Pat. No. 4,351,897 and International Publication Patent No. WO 88/04795.

In formula (M-II), $R_{10}$ represents a hydrogen atom or a substituent. $Y_4$ represents a hydrogen atom or a coupling split-off group, and particularly preferably a halogen atom or an arylthio group. Za, Zb, and Zc each represent methine, a substituted methine, =N—, or —NH—, and one of the Za-Zb bond and the Zb-Zc bond is a double bond, and the other is a single bond. If the Zb-Zc bond is a carbon-carbon double bond, it may be part of the aromatic ring. A dimer or more higher polymer formed through $R_{10}$ or $Y_4$ is included, and if Za, Zb, or Zc is a substituted methine, a dimer or more higher polymer formed through that substituted methine is included.

Of the pyrazoloazole couplers represented by formula (M-II), imidazo[1,2-b]pyrazoles described in U.S. Pat. No. 4,500,630 are preferable in view of reduced yellow subsidiary absorption of the color-formed dye and light-fastness, and pyrazolo[1,5-b][1,2,4] triazoles described in U.S. Pat. No. 4,540,654 are particularly preferable.

Further, use of pyrazolotriazole couplers wherein a branched alkyl group is bonded directly to the 2-, 3-, or 6-position of a pyrazolotriazole ring, as described in JP-A No. 65245/1976, pyrazoloazole couplers containing a sulfonamido group in the molecule, as described in JP-A No. 65246/1986, pyrazoloazole couplers having an alkoxyphenylsulfonamido ballasting group, as described in JP-A No. 147254/1986, and pyrazolotriazole couplers having an aryloxy group or an alkoxy group in the 6-position, as described in European Patent (Publication) Nos. 226,849 and 294,785, is preferable.

In formula (Y), $R_{11}$ represents a halogen atom, an alkoxy group, a trifluoromethyl group, or an aryl group, and $R_{12}$ represents a hydrogen atom, a halogen atom, or an alkoxy group. A represents $—NHCOR_{13}$, $—NHSO_2—R_3$, $—SO_2NHR_{13}$, $—COOR_{13}$, or $$—SO_2\underset{\underset{R_{14}}{|}}{N}—R_{13},$$

wherein $R_{13}$ and $R_{14}$ each represent an alkyl group, an aryl group, or an acyl group. $Y_5$ represents a coupling split-off group. Substituents of $R_{12}$, $R_{13}$, and $R_{14}$ are the same as those allowable for $R_1$, and the coupling split-off group $Y_5$ is of the type that will split off preferably at an oxygen atom or a nitrogen atom, and particularly preferably it is of the nitrogen atom split-off type.

Specific examples of couplers represented by formulae (C-I), (C-II), (M-I), (M-II) and (Y) are listed below.

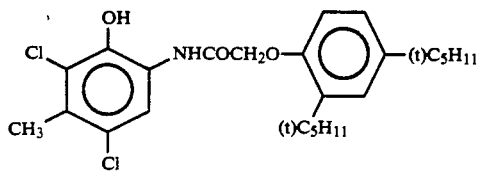

(C-1)

-continued
(C-2)
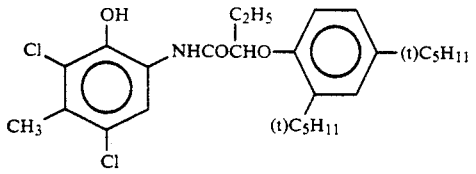
(C-3)
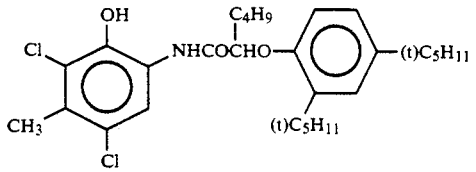
(C-4)
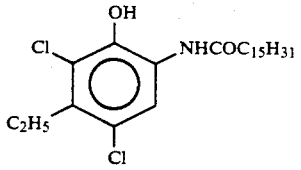
(C-5)
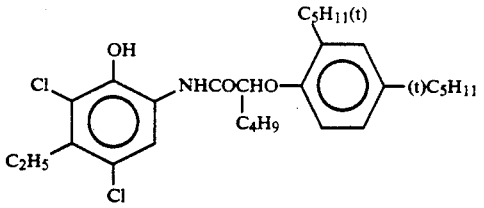
(C-6)
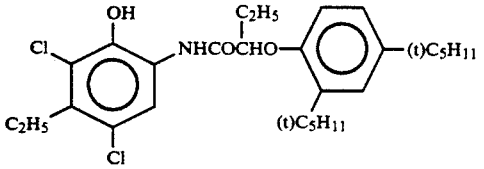
(C-7)
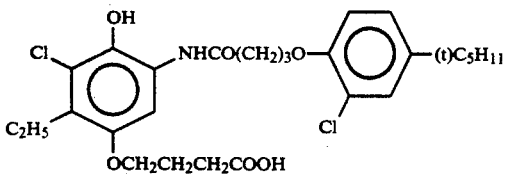
(C-8)
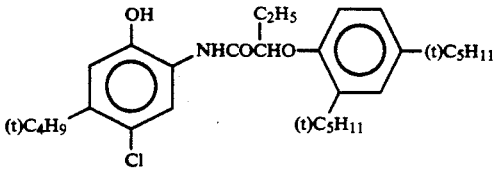
(C-9)
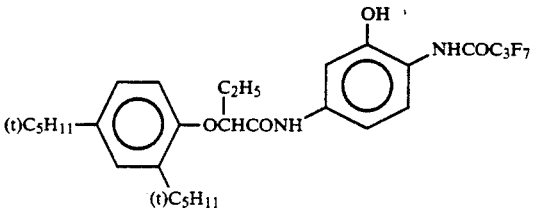

-continued
(C-10)
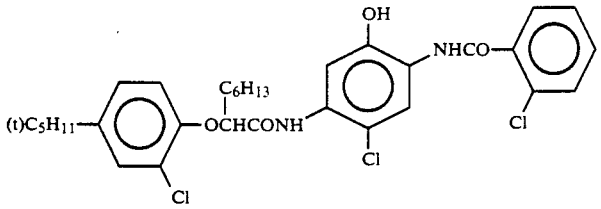
(C-11)
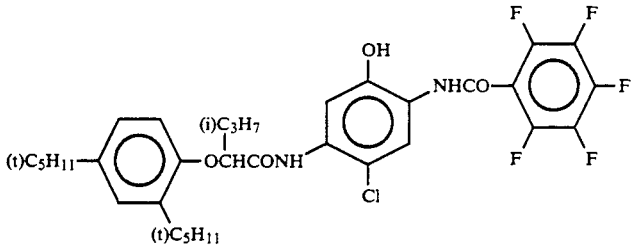
(C-12)
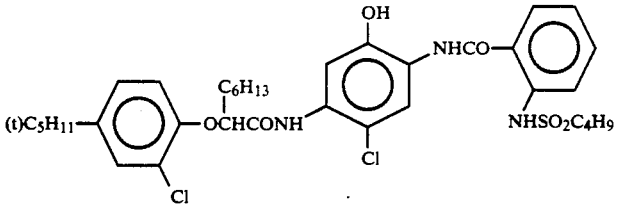
(C-13)
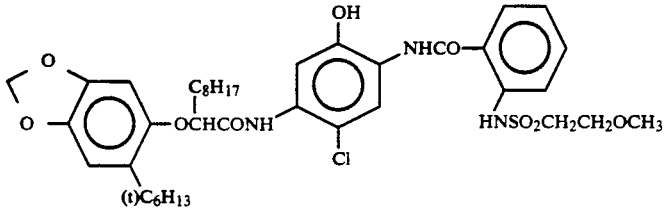
(C-14)
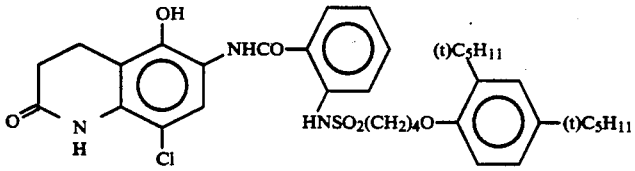
(C-15)
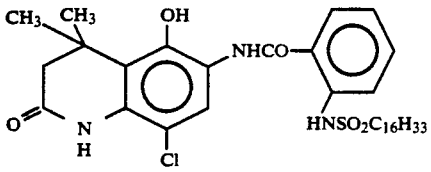
(C-16)
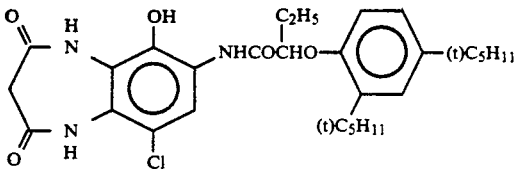

-continued
(C-17)
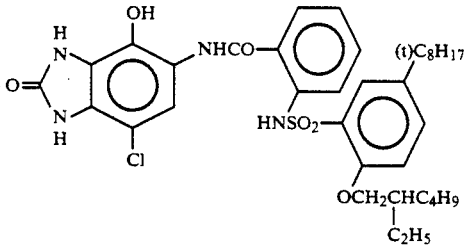
(C-18)
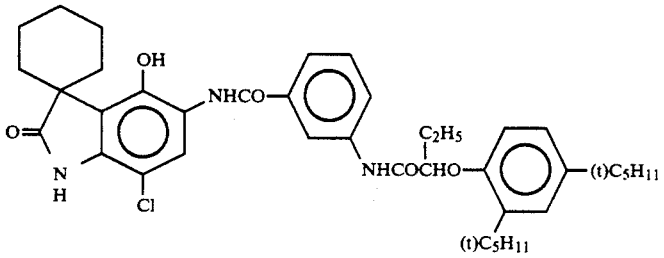
(C-19)
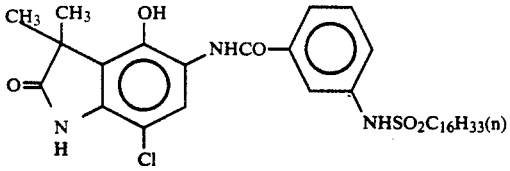
(C-20)
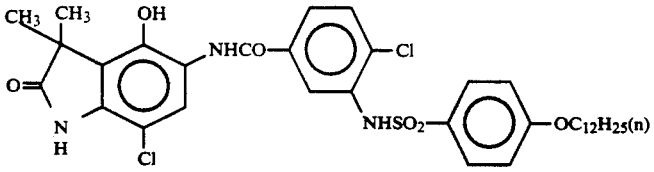
(C-21)
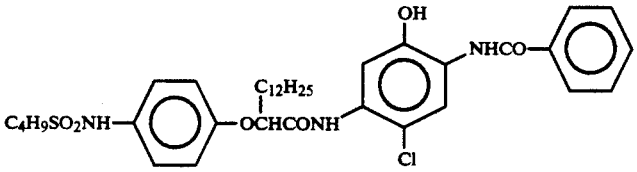
(C-22)
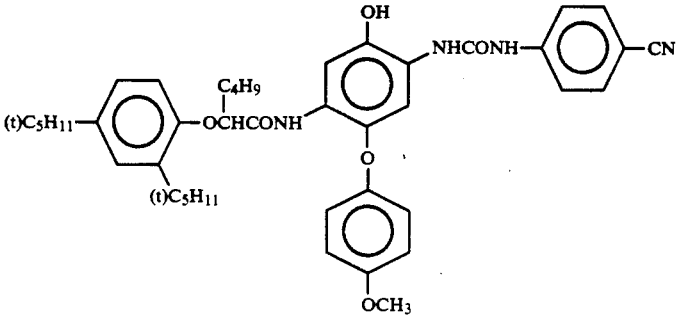

-continued
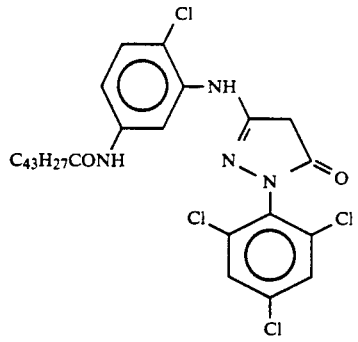
(M-1)
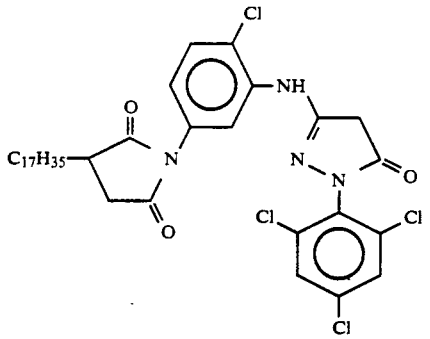
(M-2)
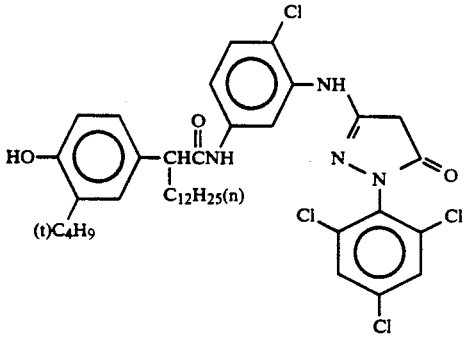
(M-3)
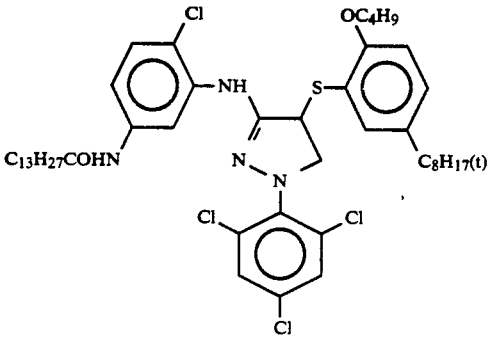
(M-4)

-continued
(M-5)
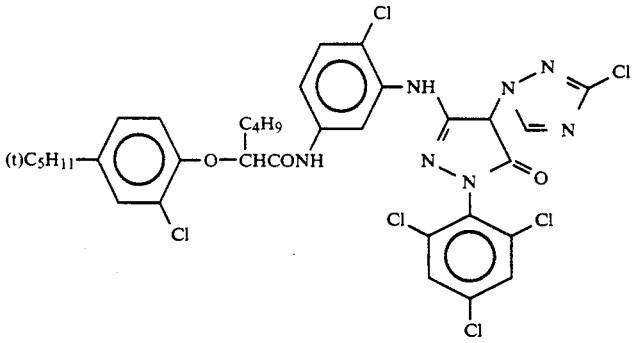
(M-6)
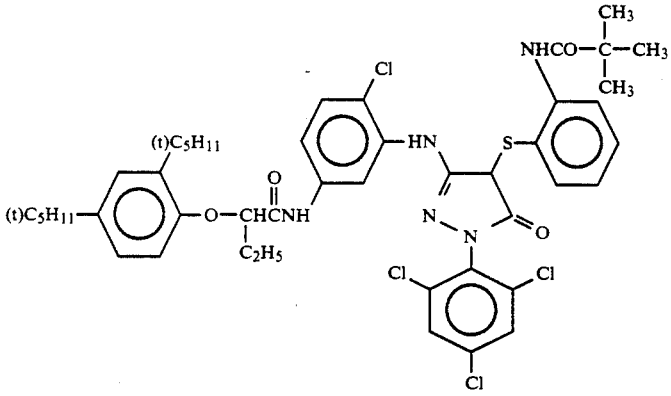
(M-7)
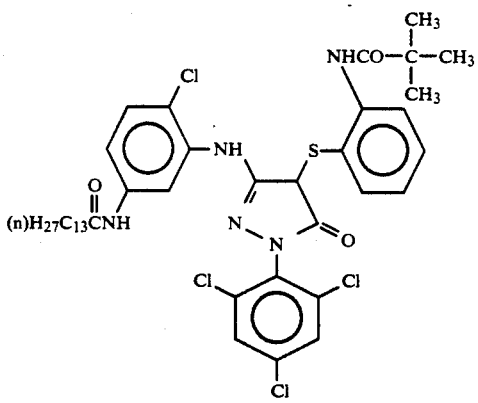
(M-8)
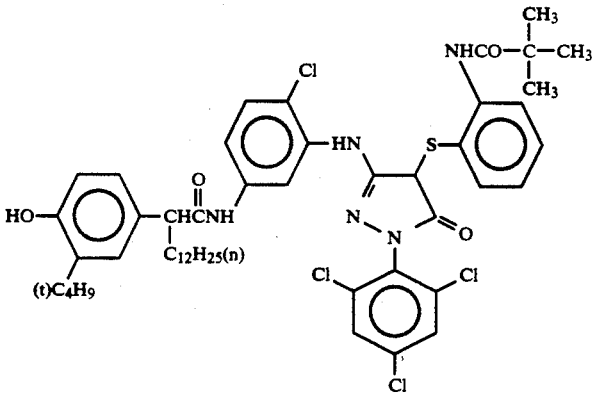

| Compound | $R_{10}$ | $R_{15}$ | $Y_4$ |
|---|---|---|---|
| | | 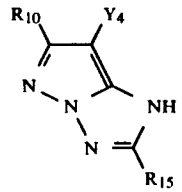 | |
| M-9 | $CH_3$— | 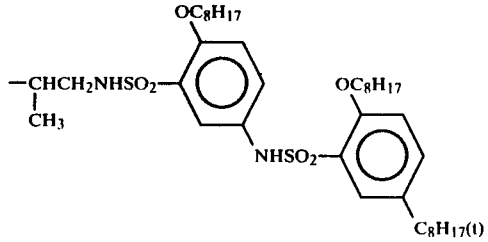 | Cl |
| M-10 | The same as the above | 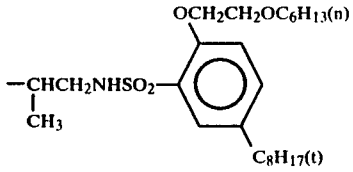 | The same as the above |
| M-11 | $(CH_3)_3C$— | 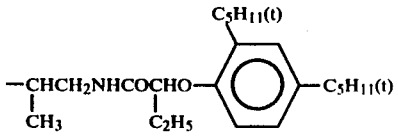 | 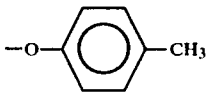 |
| M-12 | 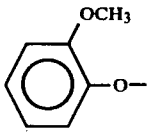 | 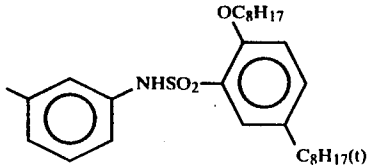 | 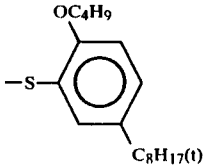 |

-continued
| Compound | $R_{10}$ | $R_{15}$ | $Y_4$ |
|---|---|---|---|
| M-13 | $CH_3$— | 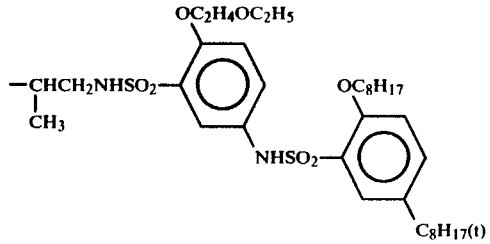 | Cl |
| M-14 | The same as the above | 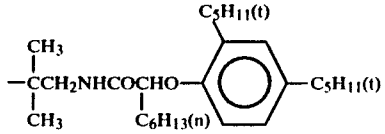 | The same as the above |
| M-15 | The same as the above | 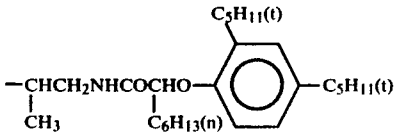 | The same as the above |
| M-16 | The same as the above | 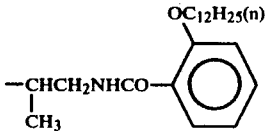 | The same as the above |
| M-17 | The same as the above | 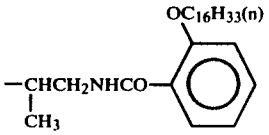 | The same as the above |

-continued
| Compound | $R_{10}$ | $R_{15}$ | $Y_4$ |
|---|---|---|---|
| M-18 | 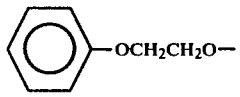 | 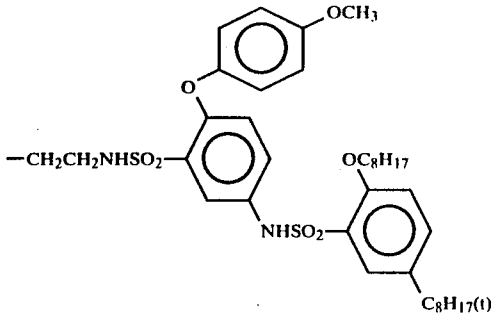 | 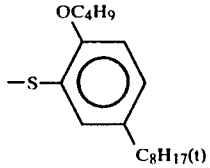 |
| M-19 | $CH_3CH_2O$— | The same as the above | The same as the above |
| M-20 | 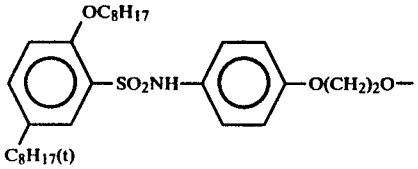 | 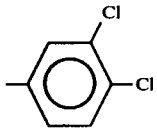 | 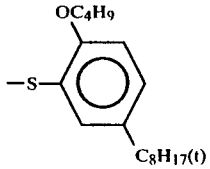 |
| M-21 | 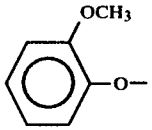 | 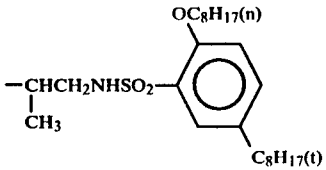 | Cl |
| | 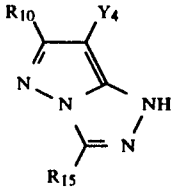 | | |
| M-22 | $CH_3$— | 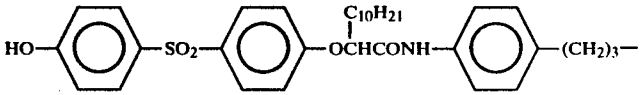 | Cl |

-continued
| Compound | $R_{10}$ | $R_{15}$ | $Y_4$ |
|---|---|---|---|
| M-23 | The same as the above | $(n)C_6H_{13}$ \ $CHCH_2SO_2-(CH_2)_2-$ / $(n)C_8H_{17}$ | The same as the above |
| M-24 | $CH_3$ \ $CH-$ / $CH_3$ | $OC_4H_9$ 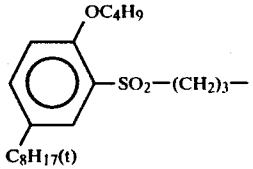 $C_8H_{17}(t)$ | The same as the above |
| M-25 | $\underset{COOCH_2CH_2OCH_3}{(CH-CH_2)_{50}}-\underset{CONH-}{(CH_2-\overset{CH_3}{C})_{50}}$ | $CH_3-CH-$ \ $CH_2NHSO_2CH_3$ | The same as the above |
| M-26 | 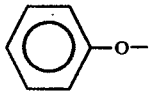 | $OC_8H_{17}$ 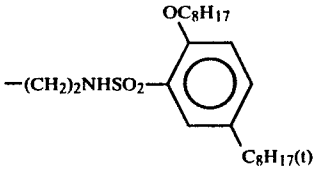 $C_8H_{17}(t)$ | The same as the above |
| M-27 | $CH_3-$ | 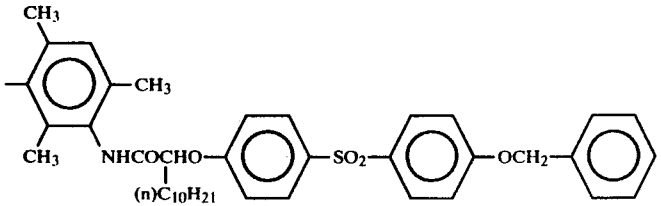 | Cl |
| M-28 | $(CH_3)_3C-$ | 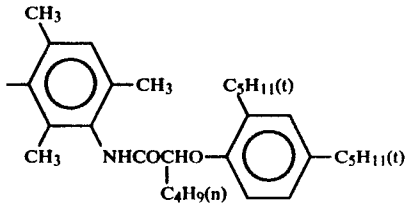 | The same as the above |

-continued
| Compound | $R_{10}$ | $R_{15}$ | $Y_4$ |
|---|---|---|---|
| M-29 | 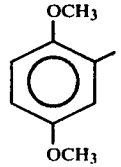 | 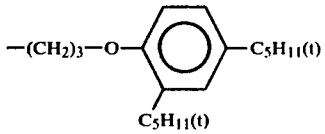 | The same as the above |
| M-30 | $CH_3$— | $(n)C_{10}H_{37}$<br>—CH—$NCOCH_2CH_2COOH$<br>$C_2H_5$ | The same as the above |

(Y-1)
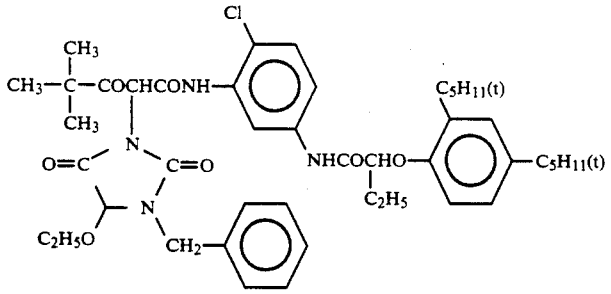
(Y-2)
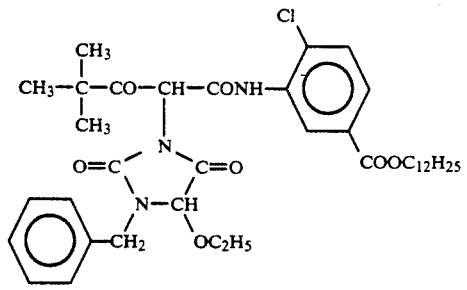
(Y-3)
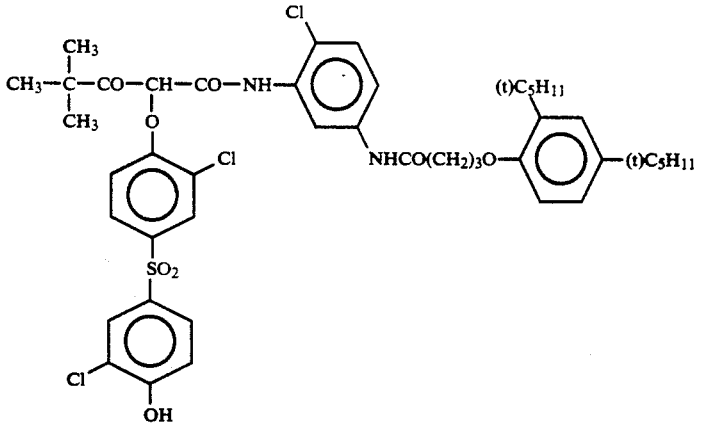
(Y-4)
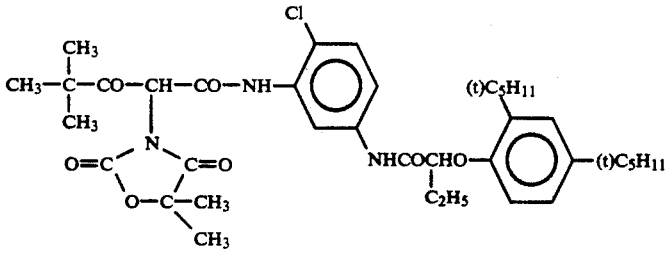
(Y-5)
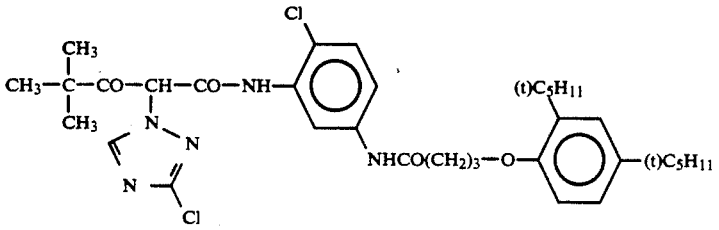

-continued (Y-6)

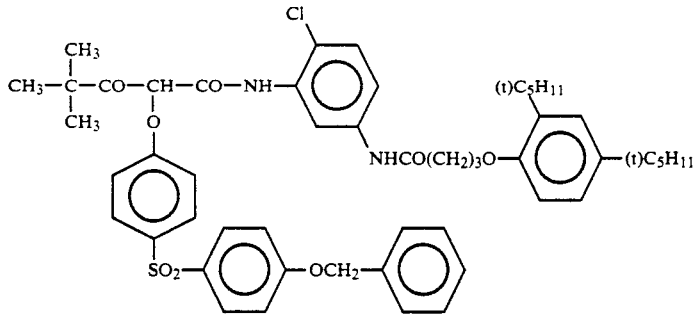

(Y-7)

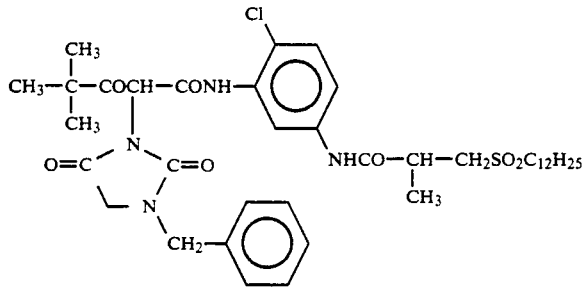

(Y-8)

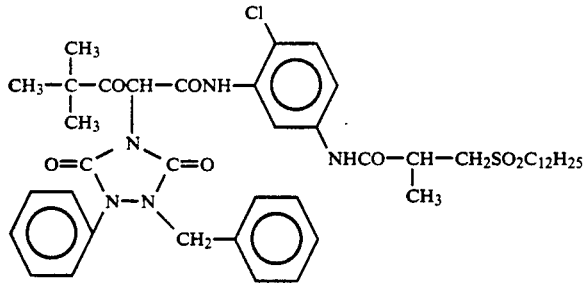

(Y-9)

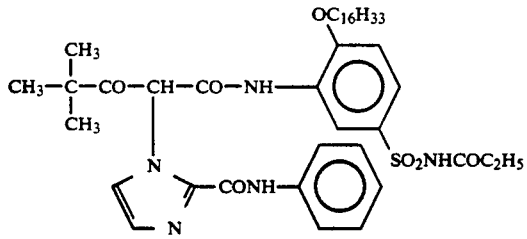

The couplers represented by formulae (C-I) to (Y) are contained in the silver halide emulsion layer constituting the photographic layer generally in an amount of 0.1 to 1.0 mol, preferably 0.1 to 0.5 mol, per mol of the silver halide.

In the present invention, in order to add the coupler to the photographic layer, various known techniques can be applied. Generally, the oil-in-water dispersion method known, as the oil-protect method, can be used for the addition, that is, after the coupler is dissolved in a solvent, it is emulsified and dispersed into an aqueous gelatin solution containing a surface-active agent. Alternatively, it is also possible that the coupler solution containing a surface-active agent can be added to water or an aqueous gelatin solution to form an oil-in-water dispersion with phase reversal of the emulsion. In the case of an alkali-soluble coupler, it can be dispersed by the so-called Fisher dispersion method. It is also possible that the low-boiling organic solvent can be removed from the coupler dispersion by means of distillation, noodle washing, ultrafiltration, or the like, followed by mixing with the photographic emulsion.

As the dispersion medium for the couplers, it is preferable to use a high-boiling organic solvent and/or a water-insoluble polymer compound having a dielectric constant of 2 to 20 (25° C.) and a refractive index of 1.5 to 1.7 (25° C.).

As the high-boiling organic solvent, a high-boiling organic solvent represented by the following formula (A'), (B'), (C'), (D'), or (E') is preferably used.

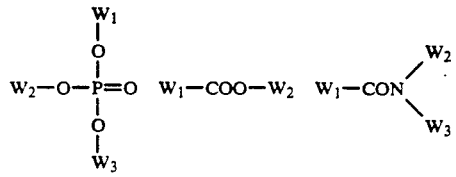

Formula (A') Formula (B') Formula (C')

-continued

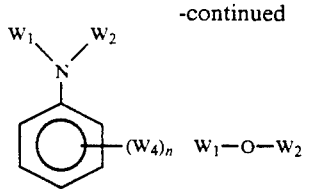

Formula (D') Formula (E')

wherein $W_1$, $W_2$, and $W_3$ each represent a substituted or unsubstituted alkyl group, cycloalkyl group, alkenyl group, aryl group or heterocyclic group, $W_4$ represents $W_1$, $OW_1$ or $S\text{-}W_1$, n is an integer of 1 to 5, when n is 2 or over, $W_4$ groups may be the same or different, and in formula (E'), $W_1$ and $W_2$ may together form a condensed ring.

As the high-boiling organic solvent used in the present invention, any compound other than compounds represented by formulae (A') to (E') can also be used if the compound has a melting point of 100° C. or below and a boiling point of 140° C. or over, and if the compound is incompatible with water and is a good solvent for the coupler. Preferably the melting point of the high-boiling organic solvent is 80° C. or below. Preferably the boiling point of the high-boiling organic solvent is 160° C. or over, and more preferably 170° C. or over.

Details of these high-boiling organic solvents are described in JP-A No. 215272/1987, page 137 (the right lower column) to page 144 (the right upper column).

The couplers can also be emulsified and dispersed into an aqueous hydrophilic colloid solution by impregnating them into a loadable latex polymer (e.g., U.S. Pat. No. 4,203,716) in the presence or absence of the above-mentioned high-boiling organic solvent, or by dissolving them in a polymer insoluble in water and soluble in organic solvents.

Preferably, homopolymers and copolymers described in International Publication Patent No. WO 88/00723, pages 12 to 30, are used, and particularly the use of acrylamide polymers is preferable because, for example, dye images are stabilized.

The photographic material that is prepared by using the present invention may contain, as color antifoggant, for example, a hydroquinone derivative, an aminophenol derivative, a gallic acid derivative, or an ascorbic acid derivative.

In the photographic material of the present invention, various anti-fading agent (discoloration preventing agent) can be used. That is, as organic anti-fading additives for cyan, magenta and/or yellow images, hydroquinones, 6-hydroxychromans, 6-hydroxycoumarans, spirochromans, p-alkoxyphenols, hindered phenols, including bisphenols, gallic acid derivatives, methylenedioxybenzenes, aminophenols, hindered amines, and ether or ester derivatives obtained by silylating or alkylating the phenolic hydroxyl group of these compounds can be mentioned typically. Metal complexes such as (bissalicylaldoximato)nickel complex and (bis-N,N-dialkyldithiocarbamato)nickel complexes can also be used.

Specific examples of the organic anti-fading agents are described in the following patent specifications:

Hydroquinones are described, for example, in U.S. Pat. Nos. 2,360,290, 2,418,613, 2,700,453, 2,701,197, 2,728,659, 2,732,300, 2,735,765, 3,982,944, and 4,430,425, British Patent No. 1,363,921, and U.S. Pat. Nos. 2,710,801 and 2,816,028; 6-hydroxychromans, 5-hydroxycoumarans, and spirochromans are described, for example, in U.S. Pat. Nos. 3,432,300, 3,573,050, 3,574,627, 3,698,909, and 3,764,337 and JP-A No. 152225/1987; spiroindanes are described in U.S. Pat. No. 4,360,589; p-alkoxyphenols are described, for example, in U.S. Pat. No. 2,735,765, British Patent No. 2,066,975, JP-A No. 10539/1984, and JP-B No. 19765/1982; hindered phenols are described, for example, in U.S. Pat. No. 3,700,455, JP-A No. 72224/1977, U.S. Pat. No. 4,228,235, and JP-B No. 6623/1977; gallic acid derivatives, methylenedioxybenzenes, and aminophenols are described, for example, in U.S. Pat. Nos. 3,457,079 and 4,332,886, and JP-B No. 21144/1981 respectively; hindered amines are described, for example, in U.S. Pat. Nos. 3,336,135, 4,268,593, British Patent Nos. 1,326,889, 1,354,313, and 1,410,846, JP-B No. 1420/1976, and JP-A Nos. 114036/1983, 53846/1984, and 78344/1984; and metal complexes are described, for example, in U.S. Pat. Nos. 4,050,938 and 4,241,155 and British Patent 2,027,731(A). To attain the purpose, these compounds can be added to the photosensitive layers by coemulsifying them with the corresponding couplers, with the amount of each compound being generally 5 to 100 wt% for the particular coupler. To prevent the cyan dye image from being deteriorated by heat, and in particular light, it is more effective to introduce an ultraviolet absorber into the cyan color-forming layer and the opposite layers adjacent to the cyan color-forming layers.

As the ultraviolet absorber, aryl-substituted benzotriazole compounds (e.g., those described in U.S. Pat. No. 3,533,794), 4-thiazolidone compounds (e.g., those described in U.S. Pat. Nos. 3,314,794 and 3,352,681), benzophenone compounds (e.g., those described in JP-A No. 2784/1971), cinnamic acid ester compounds (e.g., those described in U.S. Pat. Nos. 3,705,805 and 3,707,395), butadiene compounds (e.g., those described in U.S. Pat. No. 4,045,229), or benzoxazole compounds (e.g., those described in U.S. Pat. Nos. 3,406,070, 3,677,672, and 4,271,207) can be used. Ultraviolet-absorptive couplers (e.g., α-naphthol type cyan dye forming couplers) and ultraviolet-absorptive polymers can, for example, be used also. These ultraviolet-absorbers may be mordanted in a particular layer.

In particular, the above-mentioned aryl-substituted benzotriazole compounds are preferable.

In the present invention, together with the above couplers, in particular together with the pyrazoloazole coupler, the following compounds are preferably used.

That is, it is preferred that a compound (F), which will chemically bond to the aromatic amide developing agent remaining after the color-developing process, to form a chemically inactive and substantially colorless compound, and/or a compound (G), which will chemically bond to the oxidized product of the aromatic amide color developing agent remaining after the color-developing process, to form a chemically inactive and substantially colorless compound, are used simultaneously or separately, for example, to prevent the occurrence of stain due to the formation of a color-developed dye by the reaction of the couplers with the color-developing agent remaining in the film during storage after the processing or with the oxidized product of the color-developing agent, and to prevent other side effects.

Preferable as compound (F) are those that can react with p-anisidine a the second-order reaction-specific rate $k_2$ (in trioctyl phosphate at 80° C.) in the range of 1.0 l/mol.sec to $1\times10^{-5}$ l/mol.sec. The second-order reaction-specific rate can be determined by the method described in JP-A No. 158545/1983.

If $k_2$ is over this range, the compound itself becomes unstable, and in some cases the compound reacts with gelatin or water to decompose. On the other hand, if $k_2$ is below this range, the reaction with the remaining aromatic amine developing agent becomes slow, resulting, in some cases, in the failure to prevent the side effects of the remaining aromatic amine developing agent, which prevention is aimed at by the present invention.

More preferable as compound (F) are those that can be represented by the following formula (FI) or (FII):

$$R_1-(A_1)n-X \qquad \text{Formula (FI)}$$

$$R_2-\underset{\underset{B_1}{|}}{C}=Y \qquad \text{Formula (FII)}$$

wherein $R_1$ and $R_2$ each represent an aliphatic group, an aromatic group, or a heterocyclic group, n is 1 or 0, $A_1$ represents a group that will react with an aromatic amine developing agent to form a chemical bond therewith, X represents a group that will react with the aromatic amine developing agent and split off, $B_1$ represents a hydrogen atom, an aliphatic group, an aromatic group, a heterocyclic group, an acyl group, or a sulfonyl group, Y represents a group that will facilitate the addition of the aromatic amine developing agent to the compound represented by formula (FII), and $R_1$ and X, or Y and $R_2$ or $B_1$, may bond together to form a ring structure.

Of the processes wherein compound (F) bonds chemically to the remaining aromatic amine developing agent, typical processes are a substitution reaction and an addition reaction.

Specific examples of the compounds represented by formulae (FI), and (FII) are described, for example, in JP-A Nos. 158545/1988, 28338/1987, 2042/1989, and 86139/1989.

On the other hand, more preferable examples of compound (G), which will chemically bond to the oxidized product of the aromatic amine developing agent remaining after color development processing, to form a chemically inactive and colorless compound, can be represented by the following formula (GI):

FORMULA (GI)

$$R_3-Z$$

wherein $R_3$ represents an aliphatic group, an aromatic group, or a heterocyclic group, Z represents a nucleophilic group or a group that will decompose in the photographic material to release a nucleophilic group. Preferably the compounds represented by formula (GI) are ones wherein Z represents a group whose Pearson's nucleophilic $^nCH_3I$ value (R. G. Pearson, et al., *J. Am. Chem. Soc.*, 90, 319 (1968)) is 5 or over, or a group derived therefrom.

Specific examples of compounds represented by formula (GI) are described, for example, in European Published Patent No. 255722, JP-A Nos. 143048/1987 and 229145/1987, Japanese Patent Application No. 136724/1988, and European Published Patent Nos. 298321 and 277589.

Details of combinations of compound (G) and compound (F) are described in European Published Patent No. 277589.

The photographic material prepared in accordance with the present invention may contain, in the hydrophilic colloid layer, water-soluble dyes as filter dyes or to prevent irradiation, and for other purposes. Such dyes include oxonol dyes, hemioxonol dyes, styryl dyes, merocyanine dyes, cyanine dyes, and azo dyes. Among others, oxonol dyes, hemioxonol dyes, and merocyanine dyes are useful.

As a binder or a protective colloid that can be used in the emulsion layers of the present photographic material, gelatin is advantageously used, but other hydrophilic colloids can be used alone or in combination with gelatin.

In the present invention, gelatin may be lime-treated gelatin or acid-processed gelatin. Details of the manufacture of gelatin is described by Arthur Veis in *The Macromolecular Chemistry of Gelatin* (published by Academic Press, 1964).

As a base to be used in the present invention, a transparent film, such as cellulose nitrate film, and polyethylene terephthalate film or a reflection-type base that is generally used in photographic materials can be used. For the objects of the present invention, the use of a reflection-type base is more preferable.

The "reflection base" to be used in the present invention is one that enhances reflectivity, thereby making sharper the dye image formed in the silver halide emulsion layer, and it includes one having a base coated with a hydrophobic resin containing a dispersed light-reflective substance, such as titanium oxide, zinc oxide, calcium carbonate, and calcium sulfate, and also a base made of a hydrophobic resin containing a dispersed light-reflective substance. For example, there can be mentioned baryta paper, polyethylene-coated paper, polypropylene-type synthetic paper, a transparent base having a reflective layer, or additionally using a reflective substance, such as glass plate, polyester films of polyethylene terephthalate, cellulose triacetate, or cellulose nitrate, polyamide film, polycarbonate film, polystyrene film, and vinyl chloride resin.

As the other reflection base, a base having a metal surface of mirror reflection or secondary diffuse reflection may be used. A metal surface having a spectral reflectance in the visible wavelength region of 0.5 or more is preferable and the surface is preferably made to show diffuse reflection by roughening the surface or by using a metal powder. The surface may be a metal plate, metal foil or metal thin layer obtained by rolling, vapor deposition or galvanizing of metal such as, for example, aluminum, tin, silver, magnesium and alloy thereof. Of these, a base obtained by vapor deposition of metal is preferable. It is preferable to provide a layer of water resistant resin, in particular, a layer of thermoplastic resin. The opposite side to metal surface side of the base according to the present invention is preferably provided with an antistatic layer. The details of such base are described, for example, in JP-A Nos. 210346/1986, 24247/1988, 24251/1988 and 24255/1988.

It is advantageous that, as the light-reflective substance, a white pigment is kneaded well in the presence of a surface-active agent, and it is preferable that the surface of the pigment particles has been treated with a divalent to tetravalent alcohol.

The occupied area ratio (%) per unit area prescribed for the white pigments finely divided particles can be obtained most typically by dividing the observed area into contiguous unit areas of 6 μm×6 μm, and measuring the occupied area ratio (%) (Ri) of the finely divided particles projected onto the unit areas. The deviation coefficient of the occupied area ratio (%) can be obtained based on the ratio $s/\overline{R}$, wherein s stands for the standard deviation of Ri, and $\overline{R}$ stands for the average value of Ri. Preferably, the number (n) of the unit areas to be subjected is 6 or over. Therefore, the deviation coefficient $s/\overline{R}$ can be obtained by $$\sqrt{\frac{\sum_{i=1}^{n}(R_i - R)^2}{n-1}} \Big/ \frac{\sum_{i=1}^{n} R_i}{n}$$

In the present invention, preferably the deviation coefficient of the occupied area ratio (%) of the finely divided particles of a pigment is 0.15 or below, and particularly 0.12 or below. If the variation coefficient is 0.08 or below, it can be considered that the substantial dispersibility of the particles is substantially "uniform."

According to the present invention, by using a compound represented by formula (I), edge stain that occurs even in the case of using an above-described sizing agent for the base paper can be ameliorated remarkably.

Next, the present invention will be described in detail in accordance with examples, but the invention is not limited to these Examples.

EXAMPLE 1

Photosensitive silver halide emulsions were applied on each printing paper base as described below, thereby preparing photographic print paper samples (1) to (13).

50 wt. % of hardwood bleached kraft pulp (LBKP) and 50 wt. % of hardwood bleached sulfite pulp (LBSP) were mixed and subjected to beating to get the degree of beating of Canadians standard freeness (CSF) 280 ml.

To this stock, were added the internal sizing agent, the dry-strength agent, the retention agent, and the pH adjustor shown in Table 1 in the prescribed amounts. The stock was then made into paper, and then carboxyl-modified polyvinyl alcohol in an amount of 1.0 g/m² and calcium chloride in an amount of 1.0 g/m² were applied thereto by a size press. Then the thickness was adjusted by a calender to prepare a paper having a basis-weight of 150 g/m² and a thickness of 150 μm.

TABLE 1

| Photographic Printing Paper Sample No. | Amount of Chemicals added (weight % to oven dried pulp weight) | | | | | | | |
|---|---|---|---|---|---|---|---|---|
| | Sodium Stearate | Polyacrylamide (1) | Aluminium Sulfate | Polyamine-polyamide-epichlorohydrin (2) | Alkylketene dimer (3) | Sodium hydroxyde | Alkenylsuccinic acid (4) Anhydride | Epoxylated higher fatty acid amide (5) |
| 1 | 0 | Anionic 1.5 | 2.0 | 0.25 | 0 | 0 | 0 | 0 |
| 2 | 1.0 | " | " | " | 0 | 0 | 0 | 0 |
| 3 | 1.5 | " | " | " | 0 | 0 | 0 | 0 |
| 4 | 2.0 | " | " | " | 0 | 0 | 0 | 0 |
| 5 | 1.0 | " | " | " | 0.5 | 0 | 0 | 0 |
| 6 | 0 | " | " | " | 0.5 | 0 | 0 | 0 |
| 7 | 1.0 | " | " | " | 0.5 | pH 6.5 | 0 | 0 |
| 8 | 0 | " | " | " | 0.5 | pH 6.5 | 0 | 0 |
| 9 | 1.0 | " | " | " | 0 | 0 | 0 | 0 |
| 10 | 0 | " | " | " | 1.0 | 0 | 0 | 0.5 |
| 11 | 1.0 | " | " | " | 1.0 | 0 | 0 | 0.5 |
| 12 | 0 | " | " | " | 0 | pH 6.5 | 1.0 | 0.5 |
| 13 | 0 | Anionic 0.5 Cationic 0.5 | 0 | " | 0 | pH 6.5 | 1.0 | 0.5 |

Note:
(1) Anionic: Polyacron ST-13 (tradename, made by Hamano Kogyo Co.)
Kationic: Polystron 619 (tradename, made by Arakawa Kogyo Co.)
(2) Epinox P-130 (tradename, made by DIC-Hercules Co.)
(3) Harcon W (tradename, made by DIC-Hercules Co.)
(4) Size-pine SA-810 (tradename, made by Arakawa Kogyo Co.)
(5) NS-715 (tradename, made by Kindai Kagaku Kogyo Co.)

Polyethylene containing 10 wt. % of titanium oxide was laminated in an amount of 28 g/m² on a surface of the paper, while polyethylene was laminated in an amount of 28 g/m² on the back surface thereof, and the polyethylene surface of the base containing titanium oxide was subjected to corona discharge treatment and coated with the following silver halide emulsion layers.

PREPARATION OF A FIRST LAYER COATING SOLUTION 150 ml of ethyl acetate, 1.0 ml of a solvent (Solv-3), and 3.0 ml of a solvent (Solv-4) were added to 60.0 g of a yellow coupler (ExY) and 28.0 g of an anti-fading additive (Cpd-1) to dissolve them, and then the solution was added to 450 ml of a 10% aqueous gelatin solution containing sodium dodecylbenzenesulfonate, being dispersed thereinto by an ultrasonic homogenizer. The dispersion was mixed and dissolved into 420 g of a silver chlorobromide emulsion (silver bromide content: 0.7 mol %) containing the below-mentioned blue-sensitive sensitizing dye, to prepare a first layer coating solution.

Coating solutions for the second to seventh layers were prepared in a manner similar to that for the first coating solution. As the gelatin hardener for each layer, 1,2-bis(vinylsulfonyl)ethane was used.

As spectral sensitizers for the respective layers, the following compounds were used:

Blue-sensitive emulsion layer:
Anhydro-5,5'-dichloro-3,3'-disulfoethylthia-cyanine hydroxide Green-sensitive emulsion layer:
Anhydro-9-ethyl-5,5'-diphenyl-3,3'-disulfoethylox-acarbocyanine hydroxide Red-sensitive emulsion layer:
3,3'-Diethyl-5-methoxy-9,9'-(2,2'-dimethyl-1,3-propano)thiacarbocyanine iodide As a stabilizer for the respective emulsion layer, a mixture (7:2:1 in molar ratio) of the following compounds was used:

1-(2-Acetoaminophenyl)-5-mercaptotetrazole,
1-Phenyl-5-mercaptotetrazole, and
1-(p-Methoxyphenyl)-5-mercaptotetrazole As irradiation preventing dyes the following compounds were used:

[3-Carboxy-5-hydroxy-4-(3-(3-carboxy-5-oxo-1-(2,5-sulfonatophenyl)-2-pyrazoline-4-iridene)-1-propenyl)-1-pyrazolyl]benzene-2,5-disulfonate-disodium salt, N,N'-(4,8-Dihydroxy-9,10-dioxo-3,7-disulfonatoanthracene-1,5-diyl)bis(aminomethanesulfonate)tetrasodium salt, and

[3-Cyano-5-hydroxy-4-(3-(3-cyano-5-oxo-1-(4-sulfonatophenyl)-2-pyrazoline-4-ridene)-1-pentanyl)-1-pyrazolyl]benzene-4-sulfonato-sodium salt

COMPOSITION OF LAYERS

The composition of each layer is shown below. The figures represent coating amounts (g/m$^2$). The coating amounts of each silver halide emulsion is represented in terms of silver.

| | |
|---|---|
| Base | |
| Paper support laminated on both sides with polyethylene film and subjected to surface corona discharge treatment | |
| First Layer (Blue-sensitive emulsion layer): | |
| The above-described silver chlorobromide emulsion (AgBr: 0.7 mol %, cubic grain, average grain size: 0.9 μm) | 0.29 |
| Gelatin | 1.80 |
| Yellow coupler (ExY) | 0.60 |
| Discoloration inhibitor (Cpd-1) | 0.28 |
| Solvent (Solv-3) | 0.01 |
| Solvent (Solv-4) | 0.03 |
| Second Layer (Color-mix preventing layer): | |
| Gelatin | 0.80 |
| Color-mix inhibitor (Cpd-2) | 0.055 |
| Solvent (Solv-1) | 0.03 |
| Solvent (Solv-2) | 0.15 |
| Third Layer (Green-sensitive emulsion layer): | |
| The above-described silver chlorobromide emulsion (AgBr: 0.7 mol %, cubic grain, average grain size: 0.45 μm) | 0.18 |
| Gelatin | 1.86 |
| Magenta coupler (ExM) | 0.27 |
| Discoloration inhibitor (Cpd-3) | 0.17 |
| Discoloration inhibitor (Cpd-4) | 0.10 |
| Solvent (Solv-1) | 0.20 |
| Solvent (Solv-2) | 0.03 |
| Fourth Layer (Color-mix preventing layer): | |
| Gelatin | 1.70 |
| Color-mix inhibitor (Cpd-2) | 0.065 |
| Ultraviolet absorber (UV-1) | 0.45 |
| Ultraviolet absorber (UV-2) | 0.23 |
| Solvent (Solv-1) | 0.05 |
| Solvent (Solv-2) | 0.05 |
| Fifth Layer (Red-sensitive emulsion layer): | |
| The above-described silver chlorobromide emulsion (AgBr: 4 mol %, cubic grain, average grain size: 0.5 μm) | 0.21 |
| Gelatin | 1.80 |
| Cyan coupler (ExC-1) | 0.26 |
| Cyan coupler (ExC-2) | 0.12 |
| Discoloration inhibitor (Cpd-1) | 0.20 |
| Solvent (Solv-1) | 0.16 |
| Solvent (Solv-2) | 0.09 |
| Color-forming accelerator (Cpd-5) | 0.15 |
| Sixth layer (Ultraviolet ray absorbing layer): | |
| Gelatin | 0.70 |
| Ultraviolet absorber (UV-1) | 0.26 |
| Ultraviolet absorber (UV-2) | 0.07 |

-continued

| | |
|---|---|
| Solvent (Solv-1) | 0.30 |
| Solvent (Solv-2) | 0.09 |
| Seventh layer (Protective layer): | 1.07 |
| Gelatin | |

Compound used are as follows:

(ExY) Yellow coupler
α-Pivalyl-α-(3-benzyl-1-hidantoinyl)-2-chloro-5[β-(dodecylsulfonyl)butyramido]acetoanilide
(ExM) Magenta coupler ((A-3)-5)
7-Chloro-6-isopropyl-3-{3-[2-butoxy-5-tert-octyl)-benzenesulfonyl]propyl}-1H-pyrazolo{5,1-c}-1,2,4-triazole
(ExC-1) Cyan coupler
2-Pentafluorobenzamido-4-chloro-5[2-(2,4-di-tert-amylphenoxy)-3-methylbutyramidophenol
(ExC-2) Cyan coupler
2,4-Dichloro-3-methyl-6-[α-(2,4-di-tert-amyl-phenoxy)butyramido]phenol
(Cpd-1) Discoloration inhibitor

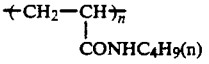

Average molecular weight: 80,000
(Cpd-2) Color-mix inhibitor
2,5-Di-tert-octylhydroquinone
(Cpd-3) Discoloration inhibitor
7,7'-dihydroxy-4,4,4',4'-tetramethyl-2,2'-spirocumarone
(Cpd-4) Discoloration inhibitor
N-(4-dodecyloxyphenyl)-morpholine
(Cpd-5) Color-forming accelerator
p-(p-Toluenesulfonamido)phenyl-dodecane
(Solv-1) Solvent
Di(2-ethylhexyl)phthalate
(Solv-2) Solvent
Dibutylphthalate
(Solv-3) Solvent
Di(i-nonyl)phthalate
(Solv-4) Solvent
N,N-diethylcarbonamido-methoxy-2,4-di-t-amylbenzene
(UV-1) Ultraviolet absorber
2-(2-Hydroxy-3,5-di-tert-amylphenyl)benzotriazole
(UV-2) Ultraviolet absorber
2-(2-Hydroxy-3,5-di-tert-butylphenyl)benzotriazole The thus-prepared samples (1) to (13) were exposed imagewise to light and subjected to a development processing by using an automatic continuous processor (Mini-labo Paper Processor FA140, manufactured Fuji Photo Film Co., Ltd.). Processing process, processing time, and processing solutions used are as follows:

| Processing steps | Temperature | Time |
|---|---|---|
| Color Developing | 38° C. | 45 sec. |
| Bleach-fixing | 35° C. | 45 sec. |
| Rinsing 1 | 35° C. | 30 sec. |
| Rinsing 2 | 35° C. | 30 sec. |
| Rinsing 3 | 35° C. | 30 sec. |
| Drying | 80° C. | 60 sec. |

| | |
|---|---|
| Color developer | |
| Water | 600 ml |
| Ethylenediamine-N,N,N',N'-tetra-methylene phosphonic acid | 2.0 g |
| Potassium bromide | 0.015 g |
| Potassium chloride | 3.1 g |
| Triethanolamine | 10.0 g |
| Potassium carbonate | 27 g |
| Fluorescent brightening agent (4,4-diaminostilbene series) | 1.0 g |
| Additive (Preservative) | See Table 2 |
| N-ethyl-N-(β-methanesulfonamidoethyl)-3-methyl-4-aminoaniline sulfate | 5.0 g |
| Water to make | 1000 ml |
| pH (25° C.) | 10.05 |
| Bleach-fixing solution | |

-continued

| | |
|---|---|
| Water | 400 ml |
| Ammonium thiosulfate (70%) | 100 ml |
| Sodium sulfite | 17 g |
| Iron (III) ammonium ethylenediaminetetraacetate | 55 g |
| Disodium ethylenediaminetetraacetate | 5 g |
| Ammonium bromide | 40 g |
| Water to make | 1000 ml |
| pH (25° C.) | 6.00 |

RINSING SOLUTION

Ion-exchanged water (contents of calcium and magnesium each are 3 ppm or below)

After processing coated samples (1) to (3) in which the preservative of color developer was changed as shown in Table 2, the degree of edge stain was observed. Evaluation of edge stain was carried out by measuring the ratio (%) of the cut end having edge stain per meter of the cut end. Results are shown in Table 2.

ent compound represented by formula (I) of the present invention, edge stain is ameliorated remarkably.

Further, it is evident that when alkylketene dimer among the sizing agents of the present invention is used, the effect fo preventing edge stain is, in particular, superior.

EXAMPLE 2

Photosensitive silver halide emulsions were applied on each printing paper base in a similar manner to that for Example 1, thereby preparing photographic print paper samples (101) to (113).

50 wt. % of hardwood bleached kraft pulp (LBKP) and 50 wt. % of hardwood bleached sulfite pulp (LBSP) were mixed and subjected to a beating process to get a degree of beating of Canadian Standard Freeness 280 ml.

To this stock were added the internal sizing agent, the paper strengthening agent, the retention agent, and the pH adjustor shown in Table 3 in the prescribed amounts. The stock was then made into paper, and then

TABLE 2

| Coating No. | Preservative: Diethylhydroxylamine | Dimethylhydroxylamine | Hydroxylamine | I-2 | I-3 | I-7 | I-30 | I-44 |
|---|---|---|---|---|---|---|---|---|
| (1) | 45 (%) | 40 (%) | 40 (%) | 35 (%) | 40 (%) | 40 (%) | 35 (%) | 40 (%) |
| (2) | 25 | 20 | 25 | 5 | 4 | 3 | 3 | 3 |
| (3) | 20 | 15 | 20 | 3 | 4 | 2 | 2 | 3 |
| (4) | 15 | 15 | 10 | 3 | 3 | 1 | 2 | 0 |
| (5) | 20 | 20 | 20 | 2 | 2 | 1 | 2 | 0 |
| (6) | 20 | 20 | 15 | 1 | 2 | 0 | 1 | 1 |
| (7) | 20 | 20 | 15 | 1 | 1 | 0 | 2 | 0 |
| (8) | 20 | 20 | 15 | 2 | 0 | 2 | 0 | 1 |
| (9) | 15 | 15 | 15 | 3 | 3 | 1 | 3 | 3 |
| (10) | 10 | 10 | 10 | 0 | 0 | 0 | 0 | 0 |
| (11) | 10 | 10 | 10 | 0 | 0 | 0 | 0 | 0 |
| (12) | 15 | 15 | 10 | 2 | 4 | 2 | 3 | 1 |
| (13) | 15 | 15 | 15 | 2 | 4 | 1 | 1 | 2 |

Note:
1) Criteria for evaluation: the ratio (%) of cut end having edge stain per meter of the cut end
0%: Level that edge stain did not occur at all.
1 to 5%: Level that edge stain occurred slightly but no trouble for practical use
6 to 20%: Level that edge stain occurred sufficient to cause trouble for practical use
over 20%: Level that edge stain occurred remarkably deteriorating its value as a commodity
2) [ ] designates results of this invention.

According to the results shown in Table 2, it can be understood that when the base of the present invention is processed in a developing solution that uses the prescarboxyl-modified polyvinyl alcohol in an amount of 1.0 g/m$^2$ and calcium chloride in an amount of 1.0 g/m$^2$ were applied thereto by a size press. Then the thickness was adjusted by a calender to prepare a paper having a basis-weight of 150 g/m$^2$ and a thickness of 150 μm.

TABLE 3

| Photographic Printing Paper Sample No. | Amount of Chemicals added (weight % to oven dried pulp weight): Sodium Stearate | Polyacrylamide (1) | Aluminium Sulfate | Polyamine-polyamide-epichlorohydrin (2) | Alkylketene dimer (3) | Sodium hydroxyde | Alkenylsuccinic acid (4) Anhydride | Epoxylated higher fatty acid amide (5) |
|---|---|---|---|---|---|---|---|---|
| 101 | 0 | Anionic 1.5 | 2.0 | 0.25 | 0 | 0 | 0 | 0 |
| 102 | 1.0 | " | " | " | 0 | 0 | 0 | 0 |
| 103 | 1.5 | " | " | " | 0 | 0 | 0 | 0 |
| 104 | 2.0 | " | " | " | 0 | 0 | 0 | 0 |
| 105 | 1.0 | " | " | " | 0.5 | 0 | 0 | 0 |
| 106 | 0 | " | " | " | 0.5 | 0 | 0 | 0 |
| 107 | 1.0 | " | " | " | 0.5 | pH 6.5 | 0 | 0 |
| 108 | 0 | " | " | " | 0.5 | pH 6.5 | 0 | 0 |
| 109 | 1.0 | " | " | " | 0 | 0 | 0 | 0.5 |
| 110 | 0 | " | " | " | 1.0 | 0 | 0 | 0.5 |
| 111 | 1.0 | " | " | " | 1.0 | 0 | 0 | 0.5 |
| 112 | 0 | " | " | " | 0 | pH 6.5 | 1.0 | 0.5 |
| 113 | 0 | Anionic 0.5 | 0 | " | 0 | pH 6.5 | 1.0 | 0.5 |

TABLE 3-continued

| Photographic Printing Paper Sample No. | Amount of Chemicals added (weight % to oven dried pulp weight) | | | | | | | |
|---|---|---|---|---|---|---|---|---|
| | Sodium Stearate | Polyacrylamide ① | Aluminium Sulfate | Polyamine-polyamide-epichlorohydrin ② | Alkylketene dimer ③ | Sodium hydroxyde | Alkenylsuccinic acid ④ Anhydride | Epoxylated higher fatty acid amide ⑤ |
| | | Cationic 0.5 | | | | | | |

Note:
① Anionic: Polyacron ST-13 (tradename, made by Hamano Kogyo Co.)
Kationic: Polystron 619 (tradename, made by Arakawa Kogyo Co.)
② Epinox P-130 (tradename, made by DIC-Hercules Co.)
③ Harcon W (tradename, made by DIC-Hercules Co.)
④ Size-pine SA-810 (tradename, made by Arakawa Kogyo Co.)
⑤ NS-715 (tradename, made by Kindai Kagaku Kogyo Co.)

By using a laminator polyethylene containing 10 wt. % of titanium oxide was laminated in an amount of 28 g/m$^2$ on the surface of the paper, while polyethylene was laminated in an amount of 28 g/m$^2$ on the back surface thereof, and the polyethylene surface of the base containing titanium oxide was subjected to corona discharge treatment and coated with the following silver halide emulsion layers.

Multilayer photographic material papers (Sample 101 to 113) were prepared by multi-coatings composed of the following layer composition on a two-side polyethylene laminated paper support. Coating solutions were prepared as follows:

PREPARATION OF THE FIRST LAYER COATING SOLUTION

To a mixture of 19.1 g of yellow coupler (ExY), 4.4 g of image-dye stabilizer (Cpd-1) and 0.7 g of image-dye stabilizer (Cpd-7), 27.2 ml of ethyl acetate and 8.2 g of solvent (Solv-1) were added and dissolved. The resulting solution was dispersed and emulsified in 185 ml of 10% aqueous gelatin solution containing 8 ml of sodium dodecylbenzenesulfonate. Separately another emulsion was prepared by adding two kinds of blue-sensitive sensitizing dye, shown below, to a blend of silver chlorobromide emulsions (cubic grains, 3:7 (silver mol ratio) blend of grains having 0.88 μm and 0.7 μm of average grain size, and 0.08 and 0.10 of deviation coefficient of grain size distribution, respectively, each in which 0.2 mol % of silver bromide was located at the surface of grains) in such amounts that each dye corresponds $2.0\times10^{-4}$ mol to the large size emulsion and $2.5\times10^{-4}$ mol to the small size emulsion, per mol of silver, and then sulfur-sensitized. The thus-prepared emulsion and the above-obtained emulsified dispersion were mixed together and dissolved to give the composition shown below, thereby preparing the first layer coating solution.

Coating solutions for the second to seventh layers were also prepared in the same manner as the first-layer coating solution. As a gelatin hardener for the respective layers, 1-hydroxy-3,5-dichloro-s-treazine sodium salt was used.

As spectral-sensitizing dyes for the respective layers, the following compounds were used:

Blue-sensitive emulsion layer:

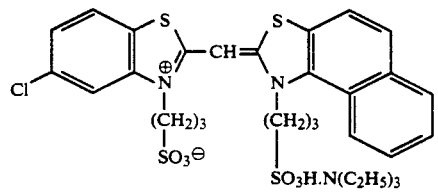

and

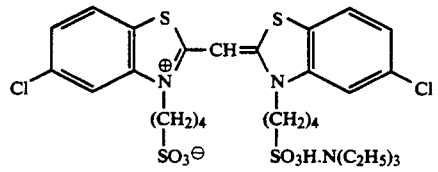

(each $2.0\times10^{-4}$ mol to the large size emulsion and $2.5\times10^{-4}$ mol to the small size emulsion, per mol of silver halide.)

Green-sensitive emulsion layer:

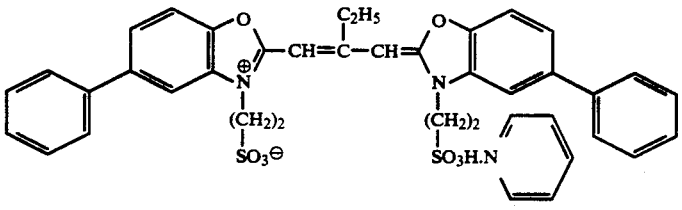

($4.0\times10^{-4}$ mol to the large size emulsion and $5.6\times10^{-4}$ mol to the small size emulsion, per mol of silver halide) and

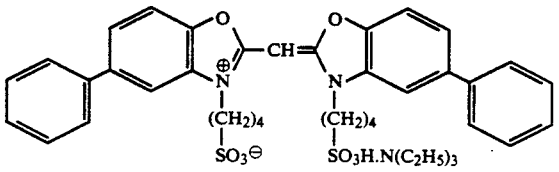

($7.0\times10^{-5}$ mol to the large size emulsion and $1.0\times10^{-5}$ mol to the small size emulsion, per mol of silver halide)

Red-sensitive emulsion layer:

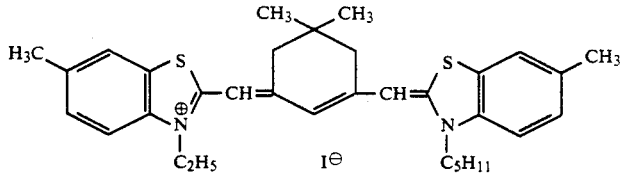

($0.9\times10^{-4}$ mol to the large size emulsion and $1.1\times10^{-4}$ mol to the small size emulsion, per mol of silver halide)

To the red-sensitive emulsion layer, the following compound was added in an amount of $2.6\times10^{-3}$ mol per mol of silver halide:

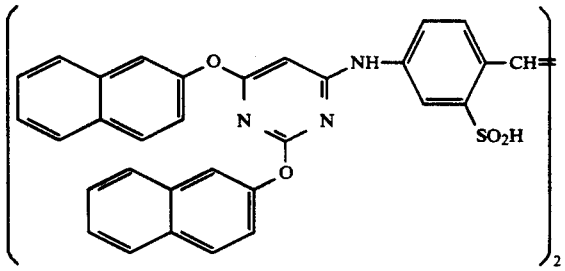

Further, 1-(5-methylureidophenyl)-5-mercaptotetrazole was added to the blue-sensitive emulsion layer, the green-sensitive emulsion layer, and the red-sensitive emulsion layer in amount of $8.5\times10^{-5}$ mol, $7.0\times10^{-4}$ mol, and $2.5\times10^{-4}$ mol, per mol of silver halide, respectively.

The dyes shown below were added to the emulsion layers for prevention of irradiation.

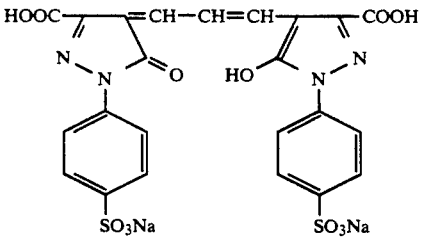

and

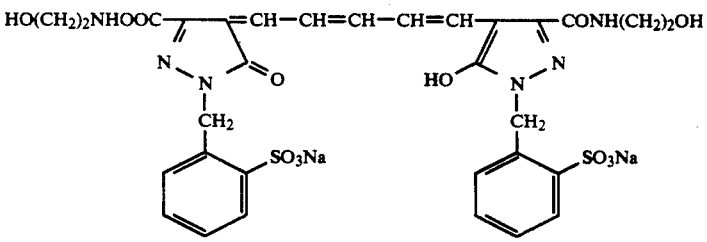

COMPOSITION OF LAYERS

The composition of each layer is shown below. The figures represent coating amount (g/m²). The coating amount of each silver halide emulsion is given in terms of silver.

SUPPORTING BASE

Paper laminated on both sides with polyethylene (a white pigment, $TiO_2$, and a bluish dye, ultramarine, were included in the first layer side of the polyethylene-laminated film)

| | |
|---|---|
| First Layer (Blue-sensitive emulsion layer): | |
| The above-described silver chlorobromide emulsion | 0.30 |
| Gelatin | 1.86 |
| Yellow coupler (ExY) | 0.82 |
| Image-dye stabilizer (Cpd-1) | 0.19 |
| Solvent (Solv-1) | 0.35 |
| Image-dye stabilizer (Cpd-7) | 0.06 |
| Second Layer (Color-mix preventing layer): | |
| Gelatin | 0.99 |
| Color mix inhibitor (Cpd-5) | 0.08 |
| Solvent (Solv-1) | 0.16 |
| Solvent (Solv-4) | 0.08 |
| Third Layer (Green-sensitive emulsion layer): | |
| Silver chlorobromide emulsions (cubic grains, 1:3 (Ag mol ratio) blend of grains having 0.55 μm and 0.39 μm of average grain size, | 0.12 |

-continued

| | |
|---|---|
| and 0.10 and 0.08 of deviation coefficient of grain size distribution. respectively, each in which 0.8 mol % of AgBr was located at the surface of grains) | |
| Gelatin | 1.24 |
| Magenta coupler (ExM) | 0.20 |
| Image-dye stabilizer (Cpd-2) | 0.03 |
| Image-dye stabilizer (Cpd-3) | 0.15 |
| Image-dye stabilizer (Cpd-4) | 0.02 |
| Image-dye stabilizer (Cpd-9) | 0.02 |
| Solvent (Solv-2) | 0.40 |
| Fourth Layer (Ultraviolet absorbing layer): | |
| Gelatin | 1.58 |
| Ultraviolet absorber (UV-1) | 0.47 |
| Color-mix inhibitor (Cpd-5) | 0.05 |
| Solvent (Solv-5) | 0.24 |
| Fifth Layer (Red-sensitive emulsion layer): | |
| Silver chlorobromide emulsions (cubic grains, 1:4 (Ag mol ratio) blend of grains having 0.58 μm and 0.45 μm of average grain size, and 0.09 and 0.11 of deviation coefficient of grain size distribution, respectively, each in which 0.6 mol % of AgBr was located at the surface of grains) | 0.23 |
| Gelatin | 1.34 |
| Cyan coupler (ExC) | 0.32 |
| Image-dye stabilizer (Cpd-6) | 0.17 |
| Image-dye stabilizer (Cpd-7) | 0.40 |
| Image-dye stabilizer (Cpd-8) | 0.04 |
| Solvent (Solv-6) | 0.15 |
| Sixth layer (Ultraviolet ray absorbing layer): | |
| Gelatin | 0.53 |
| Ultraviolet absorber (UV-1) | 0.16 |
| Color-mix inhibitor (Cpd-5) | 0.02 |
| Solvent (Solv-5) | 0.08 |
| Seventh layer (Protective layer): | |
| Gelatin | 1.33 |
| Acryl-modified copolymer of polyvinyl alcohol (modification degree: 17%) | 0.17 |
| Liquid paraffin | 0.03 |

Compounds used are as follows:

(ExY) Yellow coupler

Mixture (1:1 in molar ratio) of

R =

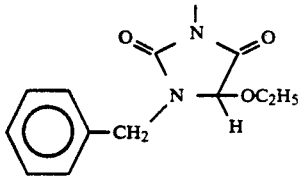

and R =

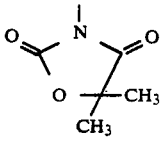

of the following formula

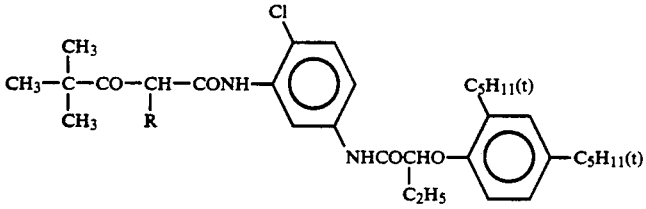

(ExM) Magenta coupler

Mixture (1:1 in molar ratio) of

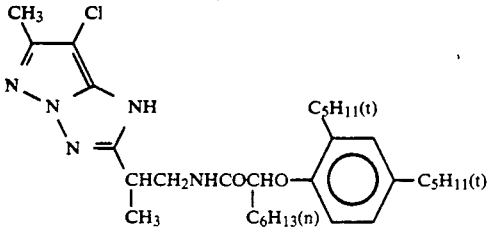

and

-continued
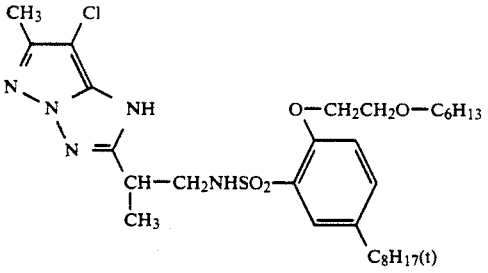
(ExC) Cyan coupler
Mixture (2:4:4 in weight ratio) of
R = $C_2H_5$ and $C_4H_9$ of
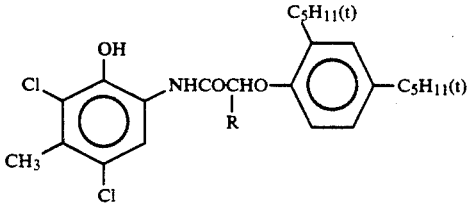
and
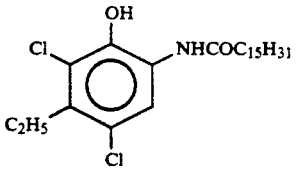
(Cpd-1) Image-dye stabilizer
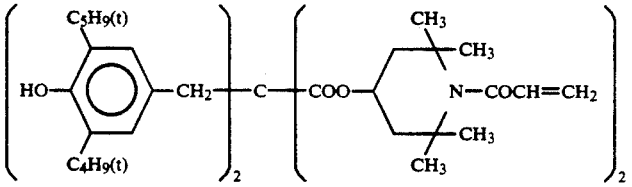
(Cpd-2) Image-dye stabilizer
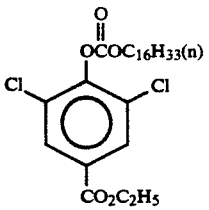
(Cpd-3) Image-dye stabilizer
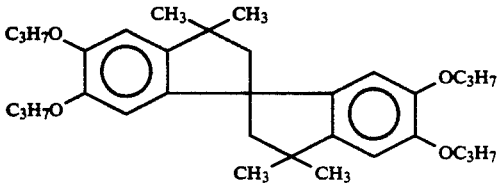
(Cpd-4) Image-dye stabilizer
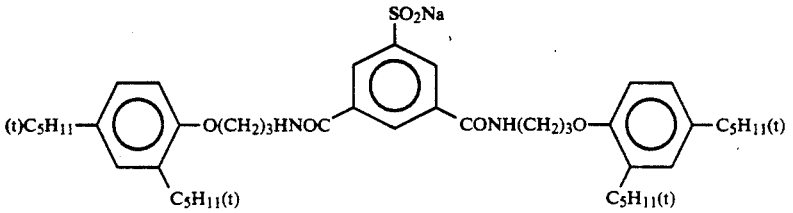
(Cpd-5) Color-mix inhibitor -continued
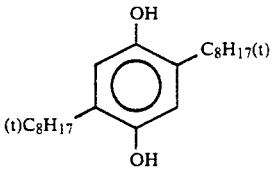
(Cpd-6) Image-dye stabilizer
Mixture (2:4:4 in weight ratio) of
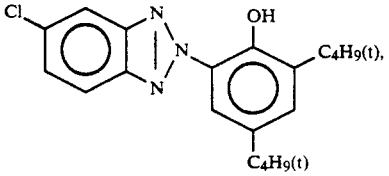
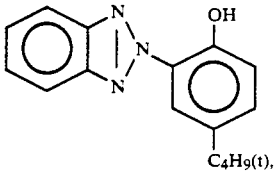
and
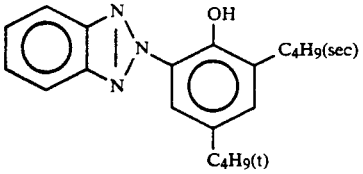
(Cpd-7) Image-dye stabilizer
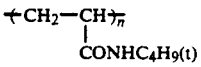
Average molecular weight: 60,000
(Cpd-8) Image-dye stablizer
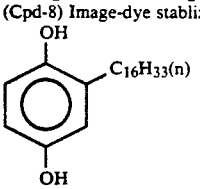
(Cpd-9) Image-dye stabilizer
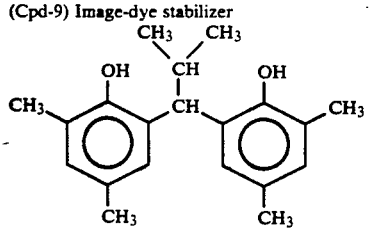
(UV-1) Ultraviolet ray absorber
Mixture (4:2:4 in weight ratio) of
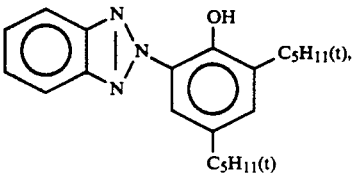
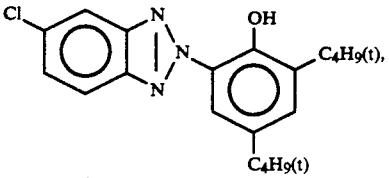
and
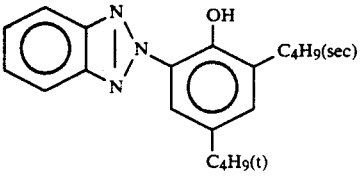

-continued (Solv-1) Solvent

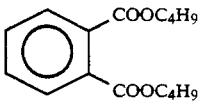

(Solv-2) Solvent
Mixture (2:1 in volume ratio) of

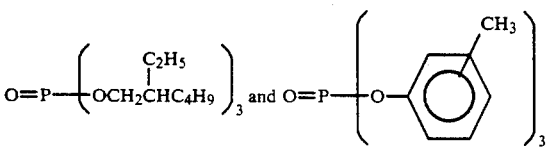

(Solv-4) Solvent

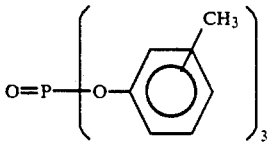

(Solv-5) Solvent (Solv-6) Solvent

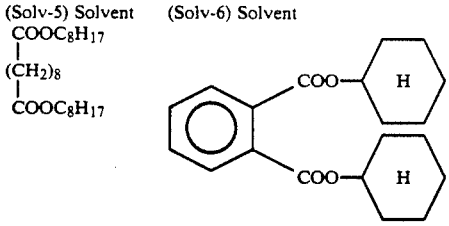

Each of the thus-prepared samples (101) to (103) was subjected to a continuous processing (running test) through the following steps shown below by using an automatic paper-processor, until a volume of color developer twice that of a tank had been replenished.

The composition of the color developer was changed as shown in Table 4.

| Processing step | Temperature | Time | Replenisher Amount* | Tank Volume |
|---|---|---|---|---|
| Color developing | 38° C. | 45 sec. | 109 ml | 4 l |
| Bleach-fixing | 30–36° C. | 45 sec. | 215 ml | 4 l |
| Stabilizing 1 | 30–37° C. | 20 sec. | — | 2 l |
| Stabilizing 2 | 30–37° C. | 20 sec. | — | 2 l |
| Stabilizing 3 | 30–37° C. | 20 sec. | 364 ml | 2 l |
| Drying | 70–85° C. | 60 sec. | | |

Note:
*Replenisher amount is shown in ml per $m^2$ of photographic material.
Stabilizing steps were carried out in 3-tanks counter-flow mode from the tank of stabilizing 3 towards the tank of stabilizing 1.
The opened surface ratio was changed by changing the size of floating lid.

The compositions of each processing solution were as follows:

| Color developer | Tank Solution | Replenisher |
|---|---|---|
| Water | 800 ml | 800 ml |
| Ethylenediamine-N,N,N',N'-tetramethylenephosphonic acid | 5.0 g | 5.0 g |
| Triethanolamine | 8.0 g | 8.0 g |
| Potassium chloride | 3.2 g | — |
| Potassium bromide | 0.015 g | — |
| Potassium carbonate | 25 g | 25 g |
| N-ethyl-N-(β-methanesulfonamidoethyl)-3-methyl-4-aminoaniline sulfonate | 5.0 g | 9.5 g |
| Organic preservative (see Table 4) | 0.03 mol | 0.05 mol |
| Sodium sulfite | 0.1 g | 0.2 g |
| Fluorescent brightening agent (diaminostilbene series, WHITEX-4, made, by Sumitomo Chemical Ind. Co.) | 1.0 g | 2.5 g |

-continued

| | | |
|---|---|---|
| Water to make | 1000 ml | 1000 ml |
| pH (25° C.) | 10.05 | 10.60 |
| **Bleach-fixing solution (Both tank solution and replenisher)** | | |
| Water | | 400 ml |
| Ammonium thiosulfate (70%) | | 100 ml |
| Sodium sulfite | | 17 g |
| Iron (III) ammonium ethylenediaminetetraacetate dihydrate | | 55 g |
| Disodium ethylenediaminetetraacetate | | 5 g |
| Glacial acetic acid | | 9 g |
| Water to make | | 1000 ml |
| pH (25° C.) | | 5.40 |
| **Stabilizing solution (Both tank solution and replenisher)** | | |
| Formalin (37%) | | 0.1 g |
| Formalin-sulfurus acid adduct | | 0.7 g |
| 5-Chloro-2-methyl-4-thiazolin-3-one | | 0.02 g |
| 2-Methyl-4-isothiazoline-3-one | | 0.01 g |

Concentrations of chloride ions and bromide ions in the developer were kept, from the beginning to the end of running process, at the concentration of tank solution by establishing the concentration of replenisher.

After running, the above coated samples were processed to evaluate the edge stain. Evaluation of edge stain was carried out in the same manner as in Example 1. Results are shown in Table 4.

TABLE 4

| Level | Photographic Paper Sample No. | Preservative | Edge stain (%) | Remarks |
|---|---|---|---|---|
| 1 | 101 | Diethyhydroxylamine | 50 | Comparative Example |
| 2 | 101 | I - 2 | 50 | " |
| 3 | 101 | I - 3 | 45 | " |

TABLE 4-continued

| Level | Photographic Paper Sample No. | Preservative | Edge stain (%) | Remarks |
|---|---|---|---|---|
| 4 | 102 | Diethyhydroxylamine | 30 | " |
| 5 | 102 | I - 7 | 4 | This Invention |
| 6 | 103 | I - 2 | 4 | " |
| 7 | 104 | I - 7 | 3 | " |
| 8 | 105 | I - 2 | 2 | " |
| 9 | 106 | I - 7 | 0 | " |
| 10 | 107 | I - 2 | 1 | " |
| 11 | 108 | I - 7 | 0 | " |
| 12 | 109 | Diethyhydroxylamine | 30 | Comparative Example |
| 13 | 109 | I - 2 | 4 | This Invention |
| 14 | 109 | I - 3 | 4 | " |
| 15 | 109 | I - 7 | 3 | " |
| 16 | 109 | I - 30 | 3 | " |
| 17 | 110 | I - 2 | 0 | " |
| 18 | 111 | I - 7 | 0 | " |
| 19 | 112 | I - 2 | 4 | " |
| 20 | 113 | I - 7 | 5 | " |

Note:
Criteria of evaluation: the ratio (%) of the cut end having edge stain per meter of the cut end
0%: Level that edge stain did not occur at all
1 to 5%: Level that edge stain occurred slightly but no trouble for practical use
6 to 20%: Level that edge stain occurred sufficient to cause trouble for practical use
over 20%: Level that edge stain occurred remarkably deteriorating its value as a commodity As is apparent from the results in Table 4, it can be understood that when the base of the present invention and the compound represented by formula (I) of the present invention are used in combination, edge stain is ameliorated remarkably.

Further, it is evident that when alkylketene dimer among the sizing agents of the present invention is used, the effect fo preventing edge stain is, in particular, superior.

EXAMPLE 3

Experiments were carried out in the same manner as in level 13 in Example 2, except that the preservative I-2 in the color developer was changed to I-8, I-11, I-12, I-14, I-19, I-20, I-23, I-26, I-27, I-31, I-40, I-42, I-43, I-44, I-52, and I-53, respectively. The same good results were obtained.

Having described our invention as related to the embodiment, it is our intention that the invention be not limited by any of the details of the description, unless otherwise specified, but rather be construed broadly within its spirit and scope as set out in the accompanying claims.

What we claim is:

1. A method for processing an image-wise exposed silver halide color photographic material containing a color coupler and comprising photosensitive silver halide emulsion layers on a paper base both sides of which are coated with a polyolefin, with a color developer containing at least one aromatic primary amino color-developing agent, which comprises processing the silver halide color photographic material the paper base of which contains at least one compound selected from the group consisting of epoxidized higher aliphatic acid amides, alkylketene dimers, higher aliphatic acid salts, and alkenyl succinic anhydrides, wherein the color developer contains a compound represented by the following Formula (I) or its salt:

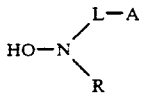

Formula (I)

wherein L represents an alkylene group, A represents a carboxyl group, a sulfo group, a phosphono group, a phosphinic acid residue, a hydroxyl group, an amino group, an ammonio group, a carbomoyl group, a sulfamoyl group or an alkylsulfonyl group, and R represents a hydrogen atom or an alkyl group.

2. The method as claimed in claim 1, wherein compound represented by Formula (I) is contained in an amount of 0.005 to 0.5 mol per liter of the color developer.

3. The method as claimed in claim 1, wherein the color developer further contains a compound represented by formula (A):

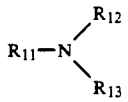

formula (A)

wherein $R_{11}$ represents a hydroxyalkyl group having 2 to 6 carbon atoms, $R_{12}$ and $R_{13}$ each represent a hydrogen atom, an alkyl group having 1 to 6 carbon atoms, a hydroxyalkyl group having 2 to 6 carbon atoms, a benzyl group, or formula

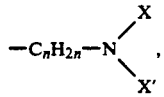

(wherein n is an integer of 1 to 6, and X and X' each represent a hydrogen atom or an alkyl group having 1 to 6 carbon atoms).

4. The method as claimed in claim 3, wherein compound represented by formula (A) is contained in an amount of 3 g to 100 g per liter of the color developer.

5. The method as claimed in claim 1, wherein the color developer further contains a compound represented by formula (B-I) or (B-II):

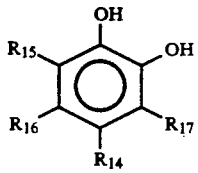

formula (B-I)

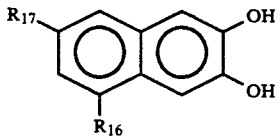

formula (B-II)

wherein $R_{14}$, $R_{15}$, $R_{16}$, and $R_{17}$, each represent a hydrogen atom, a halogen atom, a sulfonic group, an alkyl group having 1 to 7 carbon atoms, $—OR_{18}$, $—COOR_{19}$,

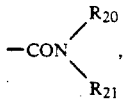

or phenyl group; and $R_{18}$, $R_{19}$, $R_{20}$, and $R_{21}$ each represent a hydrogen atom or an alkyl group having 1 to 18 carbon atoms, provided that when $R_{15}$ represents —OH or a hydrogen atom, $R_{14}$ represents a halogen atom, sulfonic group, an alkyl group having 1 to 7 carbon atoms, —$OR_{18}$, —$COOR_{19}$,

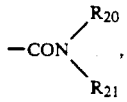

or a phenyl group.

6. The method as claimed in claim 5, wherein compound represented by formula (B-I) or (B-II) is contained in an amount of 5 mg to 15 g per liter of the color developer.

7. The method as claimed in claim 1, wherein the processing has a processing time in the range of 10 to 120 sec.

8. The method as claimed in claim 1, wherein the processing has a processing temperature in the range of 33° to 45° C.

9. The method as claimed in claim 1, wherein the epoxidized higher aliphatic acid amide is contained in ana mount of 0.01 weight % or over based on the oven-dry weight of the pulp in the base paper.

10. The method as claimed in claim 1, wherein the alkylketene dimer is contained in an amount of 0.05 weight % or over based on the oven-dry weight of the pulp in the base paper.

11. The method as claimed in claim 1, wherein the higher aliphatic acid salt is contained in an amount of 0.1 weight % or over based on the oven-dry weight of the pulp in the base paper.

12. The method as claimed in claim 1, wherein the epoxidized higher aliphatic acid amide is selected from the group of compounds having the structure represented by the following formula:

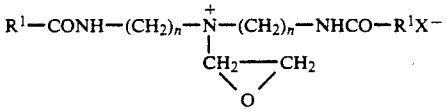

wherein $R^1$ represents a substituent, n is a positive integer, and X represents an anion.

13. The method as claimed in claim 1, wherein the alkylketene dimer is selected from the group of compounds having the structure represented by the following formula:

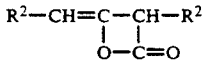

wherein $R^2$ represents an alkyl group having 12 or more carbon atoms.

14. The method as claimed in claim 1, wherein the higher aliphatic acid salt is selected from the group consisting of sodium salts or potassium salts of hexadecanoic acid, heptadecanoic acid, octadecanoic acid, eicosanoic acid, and decosanoic acid.

15. The method as claimed in claim 1, wherein the alkenyl succinic anhydride is a compound represented by the following formula:

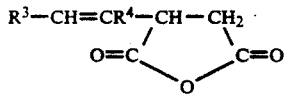

wherein $R_3$ represents a substituent, and $R_4$ represents a divalent group.

16. The method as claimed in claim 1, wherein the paper base contains two or more members selected from the group consisting of an epoxidized higher aliphatic acid amide, a alkylketene dimer, a higher aliphatic acid salt and an alkenyl succinic anhydride.

* * * * *